US008624791B2

(12) United States Patent
Payne et al.

(10) Patent No.: US 8,624,791 B2
(45) Date of Patent: Jan. 7, 2014

(54) CHOKES FOR ELECTRICAL CABLES

(71) Applicant: Venti Group, LLC, Laguna Hills, CA (US)

(72) Inventors: William Ernest Payne, Dallas, GA (US); Richard Smith, Dallas, TX (US)

(73) Assignee: Venti Group, LLC, Laguna Hills, CA (US)

( * ) Notice: Subject to any disclaimer, the term of this patent is extended or adjusted under 35 U.S.C. 154(b) by 0 days.

(21) Appl. No.: 13/910,914

(22) Filed: Jun. 5, 2013

(65) Prior Publication Data

US 2013/0265206 A1 Oct. 10, 2013

Related U.S. Application Data

(63) Continuation of application No. 13/797,963, filed on Mar. 12, 2013.

(60) Provisional application No. 61/614,175, filed on Mar. 22, 2012, provisional application No. 61/746,287, filed on Dec. 27, 2012, provisional application No. 61/765,610, filed on Feb. 15, 2013.

(51) Int. Cl.
*H01Q 21/26* (2006.01)

(52) U.S. Cl.
USPC ..... 343/797

(58) Field of Classification Search
USPC ..... 343/797, 792, 793
See application file for complete search history.

(56) References Cited

U.S. PATENT DOCUMENTS

| | | | |
|---|---|---|---|
| 2,086,976 | A | 7/1937 | Brown |
| 2,245,693 | A | 6/1941 | Lindenblad |
| 2,275,030 | A | 3/1942 | Epstein |
| 2,290,800 | A | 7/1942 | Brown |
| 2,420,967 | A | 5/1947 | Moore |
| 2,432,858 | A | 12/1947 | Brown |
| 2,570,579 | A | 10/1951 | Masters |

(Continued)

FOREIGN PATENT DOCUMENTS

| | | |
|---|---|---|
| EP | 1100148 | 5/2001 |
| GB | 463254 A | 3/1937 |

(Continued)

OTHER PUBLICATIONS

U.S. Appl. No. 13/887,054, filed May 3, 2013, Payne.

(Continued)

*Primary Examiner* — Huedung Mancuso
(74) *Attorney, Agent, or Firm* — Knobbe, Martens, Olson & Bear, LLP

(57) ABSTRACT

This disclosure relates to chokes for suppressing undesired signals such as such as common mode electromagnetic interference (EMI) and/or radio frequency interference (RFI). The chokes can include an electro-conductive sleeve disposed over an electrical cable and the sleeve can be configured to suppress an undesired signal. In some embodiments, the electro-conductive sleeve and have a half-wave sleeve, which can be electrically open at both ends. Additional insulating material can be included between the electrical cable and the sleeve. Multiple electro-conductive sleeves and be disposed substantially concentrically over the cable. The chokes can be configured to reduce passive intermodulation (PIM). The sleeve can have a longitudinal slot that extends the length of the sleeve. The sleeve can include multiple slots that separate the sleeve into multiple panels, which can be configured to suppress different signals.

9 Claims, 20 Drawing Sheets

(56) References Cited

U.S. PATENT DOCUMENTS

| | | | | |
|---|---|---|---|---|
| 2,643,334 | A | 6/1953 | Cox | |
| 2,847,670 | A | 8/1958 | Cox | |
| 2,867,804 | A | 1/1959 | Gihring | |
| 2,896,206 | A | 7/1959 | Scheldorf | |
| 2,945,231 | A | 7/1960 | Scheldorf | |
| 2,976,534 | A | 3/1961 | Kampinsky | |
| 3,262,121 | A | 7/1966 | Holloway | |
| 3,413,644 | A | 11/1968 | Laus et al. | |
| 3,546,705 | A | 12/1970 | Lemson | |
| 3,588,903 | A | 6/1971 | Hampton et al. | |
| 3,725,943 | A | 4/1973 | Spanos | |
| 3,742,510 | A | 6/1973 | Spanos | |
| 3,771,162 | A | 11/1973 | Dienes | |
| 3,789,416 | A | 1/1974 | Kuecken et al. | |
| 3,805,266 | A | 4/1974 | Fletcher et al. | |
| 3,896,450 | A | 7/1975 | Fitzroy et al. | |
| 3,919,710 | A | 11/1975 | Fletcher et al. | |
| 3,922,683 | A | 11/1975 | Kumpebeck | |
| 3,932,874 | A | 1/1976 | Woodward | |
| 4,062,019 | A | 12/1977 | Woodward et al. | |
| 4,109,254 | A | 8/1978 | Woloszczuk | |
| 4,149,170 | A | 4/1979 | Campbell et al. | |
| 4,180,820 | A | 12/1979 | Johns | |
| 4,403,222 | A | 9/1983 | Bitter, Jr. et al. | |
| 4,543,579 | A | 9/1985 | Teshirogi | |
| 4,633,265 | A | 12/1986 | Wheeler | |
| 5,287,074 | A | 2/1994 | Meguro et al. | |
| 5,293,176 | A | 3/1994 | Elliot | |
| 5,526,009 | A | 6/1996 | Mileski | |
| 5,796,372 | A | 8/1998 | Elliot | |
| 6,028,563 | A | 2/2000 | Higgins | |
| 6,057,804 | A | 5/2000 | Kaegebein | |
| 6,163,306 | A | 12/2000 | Nakamura et al. | |
| 6,255,998 | B1 | 7/2001 | Podger | |
| 6,271,800 | B1 | 8/2001 | Nakamura et al. | |
| 6,741,220 | B2 | 5/2004 | Inoue | |
| 7,053,852 | B2 | 5/2006 | Timofeev et al. | |
| 7,147,632 | B2 | 12/2006 | Prakash et al. | |
| 7,339,542 | B2 * | 3/2008 | Lalezari | 343/773 |
| 7,446,727 | B2 | 11/2008 | Kai et al. | |
| 7,449,975 | B2 | 11/2008 | Hoover | |
| 7,953,380 | B2 | 5/2011 | Birafane | |
| 8,054,236 | B2 * | 11/2011 | Martin | 343/792 |
| 8,068,066 | B2 * | 11/2011 | Perkins, III | 343/797 |
| 8,081,130 | B2 | 12/2011 | Apostolos et al. | |
| 8,289,218 | B2 | 10/2012 | Payne | |
| 8,325,101 | B2 | 12/2012 | Payne | |
| 8,427,385 | B2 | 4/2013 | Payne | |
| 8,441,406 | B2 | 5/2013 | Payne | |
| 2002/0158808 | A1 | 10/2002 | Inoue | |
| 2004/0173369 | A1 | 9/2004 | Cherniski et al. | |
| 2006/0032658 | A1 | 2/2006 | Abe | |
| 2009/0002252 | A1 | 1/2009 | Fanton | |
| 2009/0075068 | A1 | 3/2009 | Pyo et al. | |
| 2010/0220026 | A1 * | 9/2010 | Martin | 343/792 |
| 2011/0243255 | A1 | 10/2011 | Paoletti | |
| 2011/0266023 | A1 | 11/2011 | Doneker et al. | |
| 2012/0044119 | A1 | 2/2012 | Libonati et al. | |

FOREIGN PATENT DOCUMENTS

| | | | |
|---|---|---|---|
| GB | 1 311 620 | | 3/1973 |
| GB | 2 249 877 | | 5/1992 |
| GB | 2 400 497 | | 10/2004 |
| JP | 04-291806 | | 10/1992 |
| JP | 6177635 | A | 6/1994 |
| JP | 2000-030943 | | 1/2000 |
| KR | 10-0733999 | | 6/2007 |
| KR | 10-1023242 | | 3/2011 |

OTHER PUBLICATIONS

U.S. Appl. No. 13/797,963, filed Mar. 12, 2013, Payne et al.

U.S. Appl. No. 13/797,940, filed Mar. 12, 2013, Payne et al.

U.S. Appl. No. 13/910,939, filed Jun. 5, 2013, Payne et al.

"Using Ferrite Beads to Keep RF Out of TV Sets, Telephones, VCR's, Burglar Alarms and Other Electronic Equipment," available at least as early as Oct. 19, 2010.

"What are the Bumps at the End of Computer Cables?" available at least as early as Dec. 7, 2010.

International Search Report and Written Opinion for PCT/US2013/033176, mailed Jul. 15, 2013.

Freescale Semiconductor, Inc.; Compact Integrated Antennas; Freescale Semiconductor Application Note; Document No. AN2731; Rev. 1.4; Jul. 2006.

Hu, et al.; Design of the Cross-Dipole Antenna with Near-Hemispherical Coverage in Finite-Element Phased Array by Using Genetic Algorithms; 2000 IEEE International Conference on Phased Array Systems and Technology, Dana Point, California; pp. 303-306; May 21-25, 2000; Institute of Electrical and Electronics Engineers, New York, USA.

International Searching Authority; Notification of Transmittal of the International Search Report and the Written Opinion of the International Searching Authority, or the Declaration, the International Search Report, and Written Opinion of the International Searching Authority of PCT Application PCT/US2010/043767, filing date Jul. 29, 2010; mailed Feb. 23, 2011; Korean Intellectual Property Office, Daejeon, Republic of Korea.

Ronald E. Goans; Basic Antenna Theory; Apr. 8, 2008; Department of Physics and Astronomy, The University of Tennessee, Knoxville, Tennessee 37996, USA.

USPTO; Office Action dated Mar. 19, 2012, from related U.S. Appl. No. 12/534,703, filed Aug. 3, 2009.

Ye, et al.; "The Study on the Low Profile Array with High Gain"; 3rd European Conference on Antennas and Propagation, Berlin, Germany; Mar. 23-27, 2009; pp. 1547-1551; Institute of Electrical and Electronics Engineers, New York, USA.

European Patent Office; Extended European Search Report; Munich; Dec. 18, 2012.

Pre-Interview Communication for U.S. Appl. No. 13/910,939, dated Sep. 16, 2013.

International Search Report and Written Opinion for International Application No. PCT/US2013/033175, mailed Sep. 26, 2013.

* cited by examiner

CHOKES FOR ELECTRICAL CABLES

CROSS-REFERENCE TO RELATED APPLICATIONS

This application is a continuation of U.S. patent application Ser. No. 13/797,963, filed on Mar. 12, 2013, and titled CHOKES FOR ELECTRICAL CABLES, which claims the benefit under 35 U.S.C. §119(e) of U.S. Provisional Patent Application No. 61/614,175, filed on Mar. 22, 2012, and titled HALF WAVE CHOKE FOR AN ELECTRICAL CABLE, U.S. Provisional Patent Application No. 61/746,287, Filed Dec. 27, 2012, and titled RF CHOKES FOR ELECTRICAL CABLES, and U.S. Provisional Patent Application No. 61/765,610, filed Feb. 15, 2013, and titled RF CHOKES FOR ELECTRICAL CABLES, each of which is hereby incorporated by reference in its entirety and made a part of this specification.

BACKGROUND OF THE DISCLOSURE

1. Field of the Disclosure

Some embodiments of this disclosure relate to mechanisms for suppressing or blocking undesired electrical signals, and in particular to chokes for use with electrical cables for suppressing or blocking undesired signals such as common mode electromagnetic interference (EMI) and/or radio frequency interference (RFI).

2. Description of the Related Art

In some instances, electrical systems can generate undesired signals, which can propagate along an electrical cable of the electrical system. A choke can be used to suppress (e.g., attenuate or block) the undesired signals. Existing chokes can suffer from a various drawbacks.

SUMMARY OF THE DISCLOSURE

According to certain aspects, an electrical system is provided comprising an electrical cable having an insulating outer jacket. The system can include a choke configured to suppress at least electromagnetic interference (EMI) and/or radio frequency interference (RFI) having a target wavelength. The choke includes an electro-conductive sleeve disposed over the insulating outer jacket of the electrical cable. The choke can include additional insulating material disposed between the electro-conductive sleeve and the insulating outer jacket of the electrical cable. The additional insulating material can be configured to increase suppression of EMI and/or RFI by the choke.

The electrical system of can further comprise an antenna element, where electrical cable couples the antenna element to an electrical component. The electrical cable can have a radius, and in some cases the additional insulating material can have a thickness of about 1% to about 200% of the radius of the electrical cable. In some cases, the additional insulating material has a thickness of about 25% to about 100% of the radius of the electrical cable. In yet further implementations, the additional insulating material has a thickness of about 50% to about 100% of the radius of the electrical cable.

The additional insulating material can be of a different type of material than the insulating outer jacket of the electrical cable.

The electro-conductive sleeve can be a half-wave sleeve, for example.

In some cases, the electro-conductive sleeve has a length that is different than half of a free space target wavelength of the EMI and/or RFI being suppressed by an amount. The length of the electro-conductive sleeve can be determined based at least in part on one or more of a thickness of the insulating outer jacket, a dielectric constant of the insulating outer jacket, a thickness of the additional insulating material, a dielectric constant of the additional insulating material, and fringing effects of the electro-conductive sleeve. The electro-conductive sleeve in some cases has a length that is shorter than half the free space target wavelength by the amount.

In some embodiments, the electro-conductive sleeve has a length that is shorter than half the free space target wavelength by between about 1% to about 90%. In further embodiments, the electro-conductive sleeve has a length that is shorter than half the free space target wavelength by between about 5% to about 50%. The electro-conductive sleeve has a length of about half the target wavelength of the EMI and/or RFI being suppressed.

The electro-conductive sleeve can be electrically insulated from the electrical cable in some configurations. The system can further include an outer insulating layer disposed over the electro-conductive sleeve.

In some implementations, the electro-conductive sleeve extends around a full cross-sectional perimeter of the electrical cable.

The choke can be configured to suppress common mode EMI and/or RFI. In some embodiments, choke in some embodiments is configured to suppress EMI and/or RFI having a range of wavelengths that includes the target wavelength.

According to another aspect, a method is provided of applying a choke for suppressing at least electromagnetic interference (EMI) and/or radio frequency interference (RFI) having a target wavelength to an electrical cable. The method can include accessing an electrical cable comprising an insulating outer jacket. The method can further include disposing additional insulating material over the insulating outer jacket. Additionally, the method can include disposing an electro-conductive sleeve over the additional insulating material. The additional insulating material can be configured to increase suppression of EMI and/or RFI by the choke.

The electrical cable can have a radius and in some embodiments the additional insulating material has a thickness of about 1% to about 200% of the radius of the electrical cable. In further embodiments, the additional insulating material has a thickness of about 25% to about 100% of the radius of the electrical cable. According to yet further embodiments of the method, the electrical cable has a radius and the additional insulating material has a thickness of about 50% to about 100% of the radius of the electrical cable.

In some embodiments, the additional insulating material is a different type of material than the insulating outer jacket of the electrical cable.

The electro-conductive sleeve can be a half-wave sleeve.

According to some embodiments of the method, the electro-conductive sleeve has a length that is different than half of a free space target wavelength of the EMI and/or RFI being suppressed by an amount, wherein the method further comprises determining the length of the electro-conductive sleeve based at least in part on one or more of a thickness of the insulating outer jacket, a dielectric constant of the insulating outer jacket, a thickness of the additional insulating material, a dielectric constant of the additional insulating material, and fringing effects of the electro-conductive sleeve. The electro-conductive sleeve has a length that is shorter than half the free space target wavelength by the amount.

In some embodiments, the electro-conductive sleeve has a length that is shorter than half the free space target wavelength by between about 1% and about 90%. According to other embodiments, the electro-conductive sleeve has a length that is shorter than half the free space target wavelength by between about 5% and about 50%.

In some embodiments of the method, the electro-conductive sleeve is electrically insulated from the electrical cable.

The electro-conductive sleeve in some cases can have a length of about half the target wavelength of the EMI and/or RFI being suppressed.

The method can further comprise disposing an outer insulating layer over the electro-conductive sleeve. And, the electro-conductive sleeve can extend around a full cross-sectional perimeter of the electrical cable. Additionally, the choke can be configured to suppress common mode EMI and/or RFI.

The choke in some cases is configured to suppress EMI and/or RFI having a range of wavelengths that includes the target wavelength.

According to further aspects of the disclosure, an electrical system is provided. The system can include an electrical cable having an insulating outer jacket, and a choke configured to suppress at least electromagnetic interference (EMI) and/or radio frequency interference (RFI) having a target wavelength. The choke comprises an electro-conductive sleeve disposed over the insulating outer jacket of the electrical cable. The electro-conductive sleeve can be a half-wave sleeve, e.g., where length of the electro-conductive sleeve differs from half of a free space target wavelength of the EMI and/or RFI being suppressed by an amount. The length of the electro-conductive sleeve can be determined based at least in part on one or more of a thickness of the insulating outer jacket, a dielectric constant of the insulating outer jacket, and fringing effects of the electro-conductive sleeve.

According to an additional aspect, a method is provided of determining a length for an electro-conductive sleeve for use with a choke for suppressing at least electromagnetic interference (EMI) and/or radio frequency interference (RFI) having a target wavelength. The method can include determining a free space target wavelength of the EMI and/or RFI to be suppressed. The method can also include, determining, using computer hardware that comprises one or more computer processors, a length for the electro-conductive sleeve that is a half-wave sleeve, wherein the length of the electro-conductive sleeve differs from half the free space target wavelength of the EMI and/or RFI being suppressed by an amount. The length of the electro-conductive sleeve can be determined based at least in part on one or more of a thickness of an insulating outer jacket of an electrical cable, a dielectric constant of the insulating outer jacket, and fringing effects of the electro-conductive sleeve.

According to another aspect of the disclosure, a cross-dipole antenna system is provided. The system can include a cross-dipole antenna element comprising a first arm and a second arm, the first and second arms forming a first dipole. The antenna element further includes a third arm and a fourth arm, the third and fourth arms forming a second dipole. In some embodiments, each of the arms lie in a plane and are spaced apart from each other by about 90 degrees, such that a proximal end of each of the arms is arranged near a center point and wherein each of the plurality of arms extends distally outward from the center point. The cross-dipole antenna element has a substantially horizontal polarization orientation. The system can further include a coaxial electrical cable coupling the cross-dipole antenna element to an electrical component and having an insulating outer jacket. The system further includes a half-wavelength choke configured to suppress electromagnetic interference (EMI) and/or radio frequency interference (RFI) having a target wavelength. The half-wavelength choke can comprise a first electro-conductive sleeve having a first length and configured to be disposed over an outer surface of an electrical cable. The choke can further comprise a first insulating layer disposed between the first electro-conductive sleeve and the electrical cable. The choked can also comprise a second electro-conductive sleeve having a second length and disposed over the first electro-conductive sleeve. The choke can include a second insulating layer disposed between the first electro-conductive sleeve and the second electro-conductive sleeve.

In some embodiments, the first length can be about half of the target wavelength. In some embodiments, the second electro-conductive sleeve can be configured to increase the amount of suppression of EMI and/or RFI of the target wavelength. In some embodiments, the second electro-conductive sleeve has a length that is shorter than the first electro-conductive sleeve.

The first electro-conductive sleeve and the second electro-conductive sleeve can be electrically insulated from the electrical cable.

The first insulating layer in some cases can be configured to increase the frequency range of EMI and/or RFI suppressed by the choke.

The choke can be configured to suppress common mode EMI and/or RFI. In some embodiments, the electrical cable has a radius and the first insulating layer and the second insulating layer have a combined thickness of about 5% to about 200% of the radius of the electrical cable.

In some cases, the electrical cable has a radius and wherein the additional insulating material has a thickness of about 50% to about 100% of the radius of the electrical cable.

According to further aspects, an antenna system can include an antenna element and an electrical cable coupling the antenna element to an electrical component. The system can include a choke configured to suppress electromagnetic interference (EMI) and/or radio frequency interference (RFI). The choke may comprise a first electro-conductive sleeve configured to be disposed over an outer surface of the electrical cable and a second electro-conductive sleeve disposed over the first electro-conductive sleeve. The choke can also include an insulating layer disposed between the first electro-conductive sleeve and the second electro-conductive sleeve.

In some embodiments, the choke is a half-wave choke. The first and second electro-conductive sleeves can operate as coupled resonators to suppress EMI and/or RFI. In some cases, the first and second electro-conductive sleeves are mutually coupled to the cable.

The first electro-conductive sleeve and the second electro-conductive sleeve are electrically insulated from the electrical cable. In some cases, insulating material can be disposed between the first electro-conductive sleeve and an insulating outer jacket of the electrical cable. The additional insulating material can be configured to increase suppression of EMI and/or RFI by the choke. In some embodiment, the choke is configured to suppress common mode EMI and/or RFI.

According to yet further aspects of the disclosure, a choke is provided for suppressing electromagnetic interference (EMI) and/or radio frequency interference (RFI). The choke can include a first electro-conductive sleeve configured to be disposed over an outer surface of an electrical cable. The choke can additionally include a second electro-conductive sleeve disposed over the first electro-conductive sleeve. The choke can have an insulating layer disposed between the first electro-conductive sleeve and the second electro-conductive sleeve.

In some cases, the first electro-conductive sleeve is a half-wave sleeve configured to suppress at least EMI and/or RFI having a target wavelength. The second electro-conductive sleeve is a half-wave sleeve can be configured to increase suppression of at least EMI and/or RFI having the target wavelength. The choke can be a half-wave choke. In some cases the first and second electro-conductive sleeves operate as coupled resonators to suppress EMI and/or RFI. The first and second electro-conductive sleeves may be mutually coupled to the cable in some embodiments.

The first electro-conductive sleeve in some embodiments has a length of about half the target wavelength. The first electro-conductive sleeve can be configured to suppress EMI and/or RFI having a range of wavelengths that includes the target wavelength. The second electro-conductive sleeve can be configured to increase suppression of EMI and/or RFI having the range of wavelengths that includes the target wavelength.

The second electro-conductive sleeve can have a length that is shorter than the first electro-conductive sleeve. The choke can further include additional insulating material disposed under the first electro-conductive sleeve, where the additional insulating material is configured to increase suppression of EMI and/or RFI by the choke.

An electrical system can include the choke and an electrical cable disposed under the first electro-conductive sleeve. The electrical cable can comprise a coaxial cable comprising an inner conductor configured to transmit a signal, a cable insulating layer disposed over the inner conductor, a shielding layer disposed over the cable insulating layer, and an insulating outer jacket disposed over the shielding layer. The electrical cable can comprise an insulating outer jacket. And the choke can further comprise additional insulating material disposed between the insulating outer jacket and the first electro-conductive sleeve. The additional insulating material can be configured to increase suppression of EMI and/or RFI by the choke.

The electrical cable has a radius, and the additional insulating material can have a thickness of about 1% to about 200% of the radius of the electrical cable. The electrical cable in further implementations has a radius and the additional insulating material has a thickness of about 25% to about 100% of the radius of the electrical cable. In yet other cases, the electrical cable has a radius and wherein the additional insulating material has a thickness of about 50% to about 100% of the radius of the electrical cable. At least one of the first electro-conductive sleeve and the second electro-conductive sleeve can be electrically insulated from the electrical cable in some embodiments.

The choke can further comprise an outer insulating layer disposed over the second electro-conductive sleeve. And, the choke in some cases is configured to suppress common mode EMI and/or RFI.

According to yet further aspects of the disclosure, a method is provided of applying a choke for suppressing electromagnetic interference (EMI) and/or radio frequency interference (RFI) to an electrical cable. The method can include disposing a first electro-conductive sleeve over an outer surface of an electrical cable. Additionally, the method can include disposing an insulating layer over the first electro-conductive sleeve and disposing a second electro-conductive sleeve over the insulating layer such that the insulating layer is disposed between the first electro-conductive sleeve and the second electro-conductive sleeve.

The first electro-conductive sleeve can be configured to suppress at least EMI and/or RFI having a target wavelength and wherein the first electro-conductive sleeve is a half-wave sleeve. According to embodiments of the method, the second electro-conductive sleeve is configured to increase suppression of EMI and/or RFI having the target wavelength and the second electro-conductive sleeve is a half-wave sleeve. For instance, the first electro-conductive sleeve can have a length of about half the target wavelength.

In some embodiments, the first electro-conductive sleeve is configured to suppress EMI and/or RFI having a range of wavelengths that includes the target wavelength. The second electro-conductive sleeve is configured to increase suppression of EMI and/or RFI having the range of wavelengths that includes the target wavelength.

In some embodiments, the second electro-conductive sleeve has a length that is shorter than the first electro-conductive sleeve.

The method can further include disposing additional insulating material under the first electro-conductive sleeve. The additional insulating material can be configured to increase suppression of EMI and/or RFI by the choke.

In some embodiments, the electrical cable has a radius and wherein the additional insulating material has a thickness of about 25% to about 100% of the radius of the electrical cable. In yet further embodiments, the electrical cable has a radius and wherein the additional insulating material has a thickness of about 50% to about 100% of the radius of the electrical cable.

The electrical cable can include an inner conductor configured to transmit a signal, a cable insulating layer disposed over the inner conductor, a shielding layer disposed over the cable insulating layer, and an insulating outer jacket disposed over the shielding layer.

The method can further include disposing an outer insulating layer over the second electro-conductive sleeve. The choke can be configured to suppress common mode EMI and/or RFI. At least one of the first electro-conductive sleeve and the second electro-conductive sleeve can be electrically insulated from the electrical cable.

According to further aspects of the disclosure, a cellular antenna array is provided, comprising at least two antenna sub-arrays, wherein each of the at least two antenna sub-arrays comprises at least two antenna elements. The array can include a splitting module configured to couple the at least two antenna sub-arrays to at least one feed line. The array can further include at least two electrical cables coupling the splitting module to the at least two antenna sub-array. Each of the at least two electrical cables can have a first choke at or near a first end of the electrical cable and a second choke at or near a second end of the electrical cable. Each of the first and second chokes can be configured to suppress undesired radiofrequency (RF) current. Each of the first and second chokes can be configured to exhibit low passive intermodulation (PIM). In some embodiments, each of the first and second chokes include a first electro-conductive sleeve disposed over an outer surface of the corresponding electrical cable. A first longitudinal slot can be disposed between ends of the first electro-conductive sleeve. The first longitudinal slot can extend through the entire first electro-conductive sleeve, for example. The second electro-conductive sleeve can be disposed over the first electro-conductive sleeve. A second longitudinal slot can be disposed between ends of the second electro-conductive sleeve. And, the second longitudinal slot can extend through the entire second electro-conductive sleeve. In some embodiments, an insulating layer can be disposed between the first electro-conductive sleeve and the second electro-conductive sleeve.

In some embodiments, the second electro-conductive sleeve can have a length that is shorter than the first electro-conductive sleeve. Additional insulating material can be disposed between the first electro-conductive sleeve and an insulating outer jacket of the electrical cable.

The ends of the first electro-conductive sleeve can overlap such that an area near a second end is disposed over an area near a first end. An insulating material can be disposed between the area near the first end and the area near the second end. In some cases, the area near the first end and the area near the second end are capacitively coupled.

The array can further include a radiating component coupled to one of the at least two electrical cables, the radiating component configured to emit energy. The array can also include a shield member disposed over the radiating component. The shield member can be configured to suppress at least some of the energy emitted by the radiating component. One of the first and second chokes can be coupled to the shield member such that positioning the shield member over the radiating component causes the choke to be disposed over the electrical cable.

In some embodiments, the choke that is coupled to the shield member is electrically insulated from the shield member.

According to certain embodiments, the first electro-conductive sleeve and the second electro-conductive sleeve are insulated from the electrical cable. At least one of the first electro-conductive sleeve and the second electro-conductive sleeve can be a half-wave sleeve.

At least one of the first and second chokes further can comprise additional insulating material disposed between an insulating outer jacket of the electrical cable and the first electro-conductive sleeve. The additional insulating material can be configured to increase suppression of EMI and/or RFI by the choke.

In some embodiments, the electrical cable has a radius and the additional insulating material has a thickness of about 25% to about 200% of the radius of the electrical cable. In further embodiments, the electrical cable has a radius and the additional insulating material has a thickness of about 50% to about 100% of the radius of the electrical cable.

According to another aspect of the disclosure, an antenna array system is provided. The system can include a plurality of antenna elements. A splitting module can be included that is configured to couple the plurality of antenna elements to at least one feed line. The system can include an electrical cable coupling the splitting module to at least one of the plurality of antenna elements. The system includes a choke for suppressing an undesired signal, the choke configured to exhibit low passive intermodulation (PIM). The choke comprises an electro-conductive sleeve disposed over an outer surface of the electrical cable. A longitudinal slot can be disposed between ends of the electro-conductive sleeve.

The antenna array system can further comprise a radiating component coupled to the electrical cable. The radiating component can be configured to emit energy. The system can include a shield member disposed over the radiating component. The shield member can be configured to suppress at least some of the energy emitted by the radiating component. The choke can be coupled to the shield member such that positioning the shield member over the radiating component causes the choke to be disposed over the electrical cable.

The choke in some cases is electrically insulated from the shield member. The electro-conductive sleeve can be a half-wave sleeve.

According to further aspects of the disclosure an electrical system is provided including an electrical cable and a choke for suppressing an undesired signal. The choke can be configured to exhibit low passive intermodulation (PIM) and can include comprising an electro-conductive sleeve disposed over an outer surface of the electrical cable. The electro-conductive sleeve comprises substantially no nonlinearities.

In some embodiments, the electro-conductive sleeve is seamless. A longitudinal slot can be disposed between ends of the electro-conductive sleeve. The electro-conductive sleeve can extend around less than a full cross-sectional perimeter of the electrical cable. In some embodiments, the electro-conductive sleeve extends around about 50% to about 95% of the cross-sectional perimeter of the electrical cable.

An insulating material can be disposed in the longitudinal slot between the ends of the electro-conductive sleeve. In some embodiments, air is disposed in the longitudinal slot between the ends of the electro-conductive sleeve. In further embodiments, the ends of the electro-conductive sleeve overlap such that an area near a second end is disposed over an area near a first end.

An insulating material can be disposed between the area near the first end and the area near the second end. And, in some cases, the area near the first end and the area near the second end are capacitively coupled.

The electrical system can further include a plurality of antenna elements. A splitting module can be included and configured to couple the plurality of antenna elements to at least one feed line. The electrical cable can couple the splitting module to at least one of the plurality of antenna elements. The choke can be disposed at or near an end of the electrical cable coupled to the splitting module. The choke can be disposed at or near an end of the electrical cable coupled to the at least one of the plurality of antenna elements.

The system can further include a radiating component coupled to the electrical cable, the radiating component configured to emit energy. A shield member can be disposed over the radiating component. The shield member can be configured to suppress at least some of the energy emitted by the radiating component, where the choke is coupled to the shield member such that positioning the shield member over the radiating component causes the choke to be disposed over the electrical cable.

The electro-conductive sleeve can be insulated from the electrical cable. In some cases, the electro-conductive sleeve can be a half-wave sleeve.

According to certain aspects of the disclosure, a method is provided for applying a choke for suppressing an undesired signal to an electrical cable. The choked can be configured to exhibit low passive intermodulation (PIM). The method can include accessing an electrical cable. The method can also include disposing an electro-conductive sleeve over an outer surface of the electrical cable. The electro-conductive sleeve can comprise substantially no nonlinearities in some embodiments. The electro-conductive sleeve can be seamless, for example. In some embodiments, a longitudinal slot is disposed between ends of the electro-conductive sleeve. The electro-conductive sleeve can extend around less than a full cross-sectional perimeter of the electrical cable, for example.

In some embodiments, the method further includes disposing an insulating material in the longitudinal slot between the ends of the electro-conductive sleeve. Air can be disposed in the longitudinal slot between the ends of the electro-conductive sleeve. In some cases, the ends of the electro-conductive sleeve can overlap such that an area near a second end is disposed over an area near a first end. The method can further include disposing an insulating material between the area near the first end and the area near the second end. The area near the first end and the area near the second end can be capacitively coupled. The electro-conductive sleeve can be insulated from the electrical cable. In some cases, the electro-conductive sleeve is a half-wave sleeve.

According to another aspect, an electrical system is provided. The system comprises an electrical cable and a choke for suppressing an undesired signal, the choke configured to exhibit low passive intermodulation (PIM). The choke comprises a first electro-conductive sleeve disposed over an outer surface of the electrical cable. In some cases, the first electro-conductive sleeve comprises substantially no nonlinearities. A second electro-conductive sleeve can be disposed over the first electro-conductive sleeve. The second electro-conductive sleeve in some embodiments comprises substantially no nonlinearities. The system can also include an insulating layer disposed between the first electro-conductive sleeve and the second electro-conductive sleeve.

At least one of the first electro-conductive sleeve and the second electro-conductive sleeve may be seamless.

In some embodiments, a longitudinal slot is disposed between ends of at least one of the first electro-conductive sleeve and the second electro-conductive sleeve. An insulating material can be disposed in the longitudinal slot. And, the ends of the electro-conductive sleeve can overlap such that an area near a second end is disposed over an area near a first end.

In some embodiments, an insulating material can be disposed between the area near the first end and the area near the second end. The area near the first end and the area near the second end are capacitively coupled in some cases.

In some embodiments, the second electro-conductive sleeve has a length that is shorter than the first electro-conductive sleeve.

The system can further comprise additional insulating material disposed under the first electro-conductive sleeve. At least one of the first electro-conductive sleeve and the second electro-conductive sleeve may be insulated from the electrical cable. At least one of the first electro-conductive sleeve and the second electro-conductive sleeve may be a half-wave sleeve, for example.

In certain embodiments, the system comprises a plurality of antenna elements and can include a splitting module configured to couple the plurality of antenna elements to at least one feed line. The electrical cable can couple the splitting module to at least one of the plurality of antenna elements.

The system can further include a radiating component coupled to the electrical cable, where the radiating component is configured to emit energy. A shield member can be disposed over the radiating component. The shield member can be configured to suppress at least some of the energy emitted by the radiating component. The choke in some cases is coupled to the shield member such that positioning the shield member over the radiating component causes the choke to be disposed over the electrical cable.

According to aspects of the disclosure, a method of applying a choke for suppressing an undesired signal to a cable. The choke can be configured to exhibit low passive intermodulation (PIM). The method can include disposing a first electro-conductive sleeve over an outer surface of an electrical cable. The first electro-conductive sleeve comprises substantially no nonlinearities in some cases. The method can also include disposing an insulating layer over the first electro-conductive sleeve and disposing a second electro-conductive sleeve over the insulating layer such that the insulating layer is disposed between the first electro-conductive sleeve and the second electro-conductive sleeve. The second electro-conductive sleeve may comprise substantially no nonlinearities.

In some cases, at least one of the first electro-conductive sleeve and the second electro-conductive sleeve are seamless. According to some embodiments, a longitudinal slot is disposed between ends of at least one of the first electro-conductive sleeve and the second electro-conductive sleeve. In certain embodiments, an insulating material is disposed in the longitudinal slot. The ends of the electro-conductive sleeve can overlap such that an area near a second end is disposed over an area near a first end.

An insulating material can be disposed between the area near the first end and the area near the second end. The area near the first end and the area near the second end are capacitively coupled in some case. The second electro-conductive sleeve has a length that is shorter than the first electro-conductive sleeve in certain embodiments. The method can further comprise disposing additional insulating material under the first electro-conductive sleeve.

The electro-conductive sleeve can be insulated from the electrical cable. In some cases, the electro-conductive sleeve can a half-wave sleeve.

According to further aspects, an electrical system is provided comprising an electrical cable and a choke for suppressing, the choke comprising an electro-conductive sleeve disposed over an outer surface of the electrical cable. The electro-conductive sleeve may include a first panel and a second panel separated from the first panel by two or more slots running longitudinally along the electro-conductive sleeve.

In some embodiments, the first panel has a first length configured to suppress signals having at least a first target wavelength and the second panel has a second length configured to suppress signals having at least a second target wavelength. The first length may be about half the first target wavelength. The second length may be about half the second target wavelength.

In some cases, the first panel is configured to suppress signals having a first range of wavelengths that includes the first target wavelength. The second panel can be configured to suppress signals having a second range of wavelengths that includes the second target wavelength.

In certain embodiments, the system further comprises a third panel having the first length, wherein the third panel is disposed generally opposite the first panel. The system can additionally include and a fourth panel having the second length, wherein the fourth panel is disposed generally opposite the second panel.

An end of the first panel can overlap an end of the second panel such that an area near the end of the first panel is disposed over an area near the end of the second panel. An insulating material is disposed between the area near the end of the first panel and the area near the end of the second panel. The area near the end of the first panel can be capacitively coupled to the area near the end of the second panel.

The choke may be configured to suppress common mode electromagnetic interference (EMI) and/or radio frequency interference (RFI). And, the electro-conductive sleeve can be insulated from the electrical cable.

In some cases, the electro-conductive sleeve is a half-wave sleeve.

The choked in certain embodiments is configured to suppress an undesired radiofrequency (RF) signal. The choke can be configured to suppress electromagnetic interference (EMI) and/or radio frequency interference (RFI).

According to yet further aspects, a method is provided of applying a choke for suppressing an undesired signal to an electrical cable. The method can comprise accessing an electrical cable and disposing an electro-conductive sleeve over an outer surface of the electrical cable. The electro-conductive sleeve can comprise two or more panels separated by two or more longitudinal slots.

In some embodiments, a first panel has a first length configured to suppress signals having a first target wavelength and a second panel has a second length configured to suppress signals having a second target wavelength. The first length can be about half the first target wavelength. The second length can be about half the second target wavelength. The first panel can be configured to suppress signals having a first range of wavelengths that includes the first target wavelength. The second panel can be configured to suppress signals having a second range of wavelengths that includes the second target wavelength.

In certain embodiments, a third panel has the first length, the third panel disposed generally opposite the first panel, and a fourth panel has the second length, the fourth panel disposed generally opposite the second panel.

An end of the first panel can overlap an end of the second panel such that an area near the end of the first panel is disposed over an area near the end of the second panel.

The method can further include disposing an insulating material between the area near the end of the first panel and the area near the end of the second panel. The area near the end of the first panel can be capacitively coupled to the area near the end of the second panel.

In some configurations, the choke is configured to suppress common mode electromagnetic interference (EMI) and/or radio frequency interference (RFI). The electro-conductive sleeve can be insulated from the electrical cable. The electro-conductive sleeve can be a half-wave sleeve. The choke in some cases is configured to suppress an undesired radiofrequency (RF) signal. In some cases, the choke is configured to suppress electromagnetic interference (EMI) and/or radio frequency interference (RFI).

DETAILED DESCRIPTION OF CERTAIN EMBODIMENTS

Figure 1:
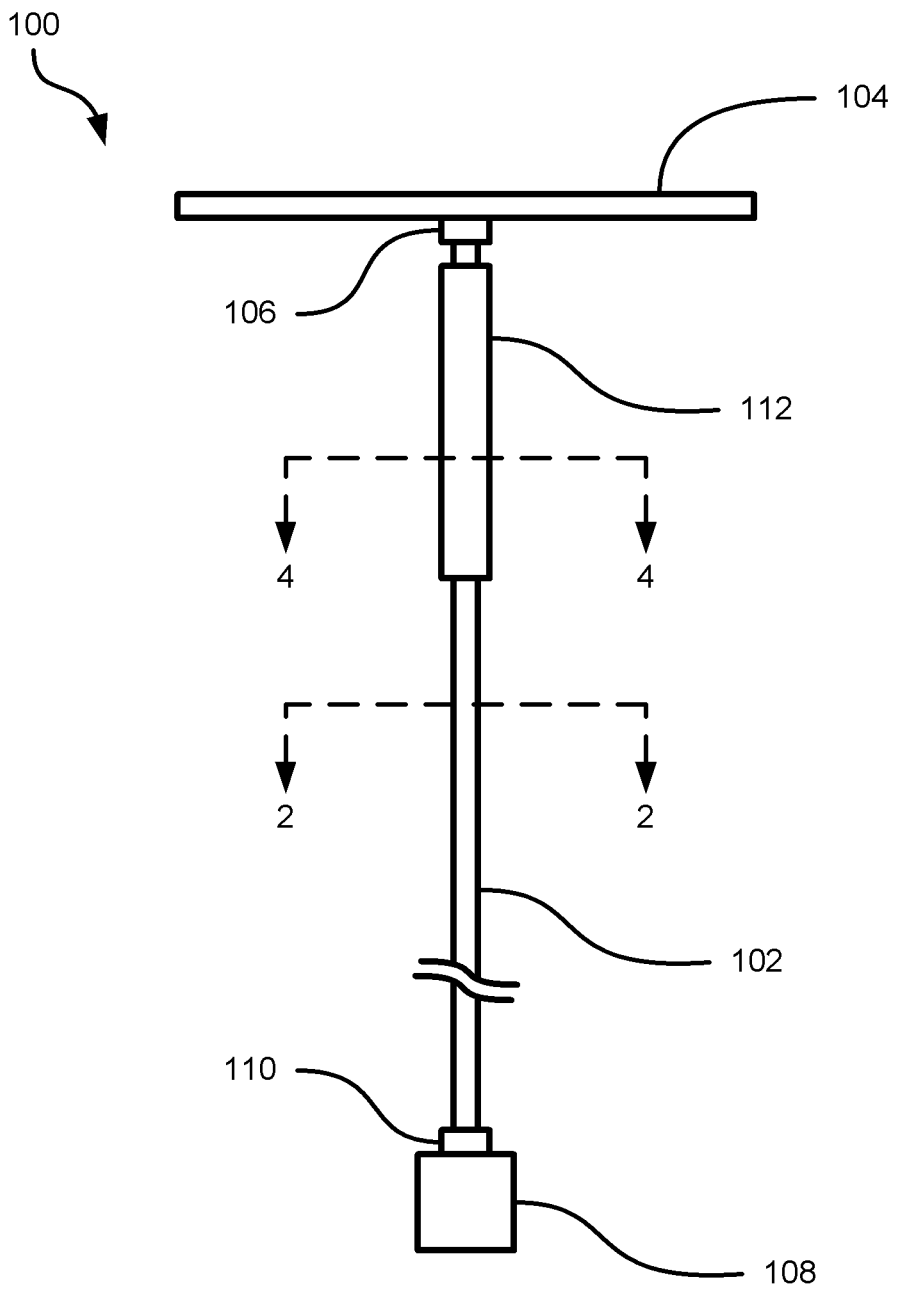
FIG. 1 is a schematic view of an example embodiment of an electrical system, which can include an electrical cable (e.g., a coaxial cable) coupled to an electrical component.

FIG. 1 is a schematic view of an example embodiment of an electrical system 100, which can include an electrical cable 102 (e.g., a coaxial cable) coupled to an electrical component 104. The electrical component 104 can be an antenna element in various embodiments disclosed herein, although various other electrical components can be used (e.g., a television or other display device, a computing device, a computer peripheral device, an electrical appliance, etc.).

The antenna element 104 can be a horizontally polarized antenna element, such as a cross-dipole antenna, which is generally driven by a single coaxial cable, includes one pair of arms (first dipole) longer than a second pair of arms (second dipole), where phase shifts are established by the arms themselves, e.g., without the need for an external phase shifter or a second coax. In such cases, radiation travelling on the electrical cable 102 towards the antenna element 104 (e.g., via the center conductor of the coaxial cable) can cause undesirable EMI and/or RFI interference. For example, radiation travelling towards the antenna element 104 up the center conductor of the coaxial cable 102 can reflect off of the antenna element 104 and travel back down the outer surface of the coaxial cable. This can create unbalanced current flow on the coaxial cable, impairing performance of the antenna element 104. For instance, the unbalanced current flow can result in radiation which may interfere with the horizontal polarization of the antenna element 104 or otherwise impair performance. Various features and elements relating to antenna elements, including cross-dipole, horizontally polarized antenna elements which can be implemented in connection with the electrical system 100, are disclosed in U.S. Patent Publication No. 2011/0068992, titled CROSS-DIPOLE ANTENNA CONFIGURATIONS, published on Mar. 24, 2011, and filed on Jul. 21, 2010, U.S. Patent Publication No. 2011/0025569, titled CROSS-DIPOLE ANTENNA COMBINATION, published on Feb. 3, 2011, and filed on May 21, 2010, and U.S. Patent Publication No. 2011/0025573, titled CROSS-DIPOLE ANTENNA, published on Feb. 3, 2011, and filed on Aug. 3, 2009. The entirety of each of these publications is hereby incorporated by reference and made a part of this specification. In one embodiment, the antenna element 104 is a cross-dipole, horizontally polarized antenna where arms of the cross dipole antenna that are coupled to a center conductor of the coaxial cable remain of conventional length, but the arms of the cross dipole antenna that are coupled to a shield of the coaxial cable are lengthened by a fraction of the radius (half the diameter) of the coaxial cable. Various other embodiments of antennas which can be used with the electrical chokes described herein are described in the '992, '569, '573, and publications. In some cases, the antenna element 104 has some other polarization instead of or in addition to a horizontal polarization. For instance, the antenna element 104 may be vertically or circularly polarized in some cases. Moreover, while the antenna element 104 can be a cross-dipole antenna in some cases, other types of antennas can be used (e.g., turnstile antennas).

In some embodiments, the electrical cable 102 can couple to the electrical component 104 by a connector 106, while in other embodiments, the electrical cable 102 can couple directly to the electrical component 104. The electrical cable 102 can be configured to provide power to the electrical component 104 and/or to deliver control signals to and/or from the electrical component 104. For example, in some embodiments, the electrical cable 102 can be a feed line for an antenna element. In some embodiments, the electrical cable 102 can couple the electrical component to another electrical component 108 (e.g., a power source, a splitting module, a computing device, etc.) directly or via a connector 110. A choke 112 can be disposed on the electrical cable 102 to suppress undesired signals.

The choke 112 can be disposed at or near the electrical component 104 (e.g., at or near the end of the electrical cable 102). For example, the choke 112 can be disposed directly adjacent to the electrical component 104 or the connector 106, or the choke 112 can be spaced apart from the electrical component 104 or connector 106 by a distance of less than about 0.1 mm, less than about 0.25 mm, less than about 0.5 mm, less than about 1.0 mm, less than about 1.25 mm, less than about 1.5 mm, less than about 3.0 mm, less than about 5.0 mm, less than about 10 mm, less than about 20 mm, less than about 50 mm, or less than about 100 mm, although larger distances can be used. In some embodiments, the choke 112 can be spaced apart from the electrical component 104 or the connector 106 by a distance of at least about 0.1 mm, at least about 0.2 mm, at least about 0.3 mm, at least about 0.5 mm, at least about 0.75 mm, at least about 1.0 mm, at least about 1.5 mm, at least about 2.0 mm, at least about 5.0 mm, or more. In some embodiments, the choke 112 can be disposed at or near the other electrical component 108 or connector 110 that is coupled to the electrical cable 102. In some embodiments, the choke 112 can be spaced apart from both electrical components 104 and 108, e.g., at a generally midsection of the electrical cable 102.

Figure 2:
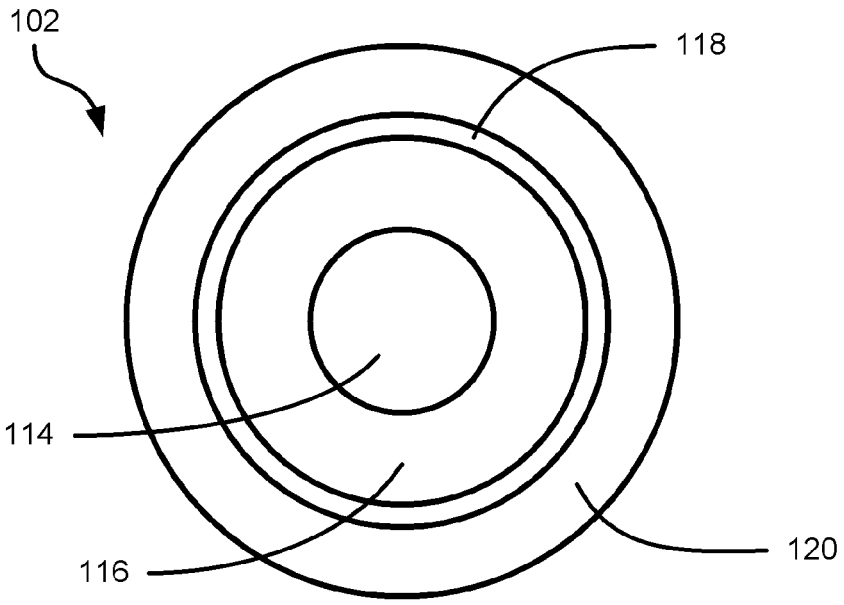
FIG. 2 is a cross-sectional view of an example embodiment of the electrical cable taken through the line 2-2 of FIG. 1.
Figure 3:
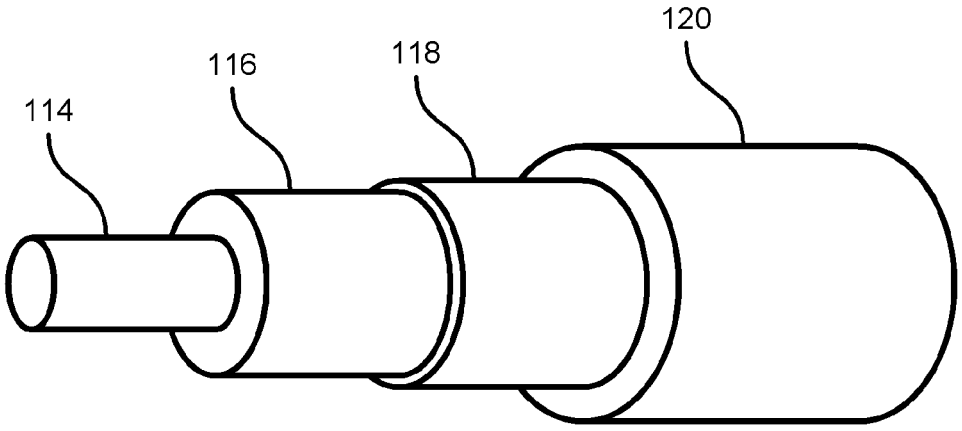
FIG. 3 is a perspective view of a section of the electrical cable with portions of various layers hidden from view to facilitate viewing of the various layers.

FIG. 2 is a cross-sectional view of an example embodiment of the electrical cable 102 taken through the line 2-2 of FIG. 1. FIG. 3 is a perspective view of a section of the electrical cable 102 with portions of various layers hidden from view to facilitate viewing of the various layers. The electrical cable 102 can be a coaxial cable, although various types of cables can be used. The electrical cable 102 can include an inner conductor 114 configured to deliver power and/or control signals to or from the electrical component 104, a cable insulating layer 116 disposed over the inner conductor 114, a shielding layer 118 disposed over the cable insulating layer 116, and an outer jacket 120 disposed over the shielding layer 118.

As used herein, the terms "over" and "under" sometimes refer to the relative positions of various components with respect to a center or longitudinal axis of an electrical cable or choke. For example, a first component can be "under" a second component if the first component is closer to the center or longitudinal axis than the second component or if the first component is disposed radially inward from the second component. Similarly, a second component can be "over" a first component if the second component is further from the center or longitudinal axis than the first component or if the second component is disposed radially outward from the first component.

The inner conductor 114 can be a copper wire or other electro-conductive material. The cable insulating layer 116 can be made of an insulating material (e.g., a dielectric material) such as fluorinated ethylene propylene (FEP). The shielding layer 116 can be made of an electro-conductive material (e.g., copper) and can be braided. The outer jacket 120 can be made of an insulating material such as FEP or polyvinyl chloride (PVC). Various other materials can be used, and many other variations are possible. For example, in some embodiments, a foil shield (not shown) can be included, which can be made of an electro-conductive material (e.g., aluminum) and can be disposed, for example, between the cable insulating layer 116 and the shielding layer 118.

In antenna systems, as well as in other electrical systems 100, an undesired signal (e.g., a radio frequency (RF) signal) can be produced. For example, in some cases the electrical cable 102 can operate as an antenna element which can transmit and/or receive undesired signals (e.g., RF signals). In some instances, an undesired current can flow along a portion of the electrical cable 102 (e.g., along an outside of the electrical cable 102 or along the shielding layer 118 of the electrical cable 102), which is commonly referred to as common mode electromagnetic interference (EMI) or radio frequency interference (RFI). In some cases, the current of the undesired electrical current can propagate in a direction along the cable 102 that is substantially opposite the direction of the current propagating in the inner conductor 114 of the cable 102. The choke 112 can be configured to suppress EMI and/or RFI. The chokes can be configured to suppress RF signals (e.g., ranging from 9 kHz to 300 GHz).

Figure 4:
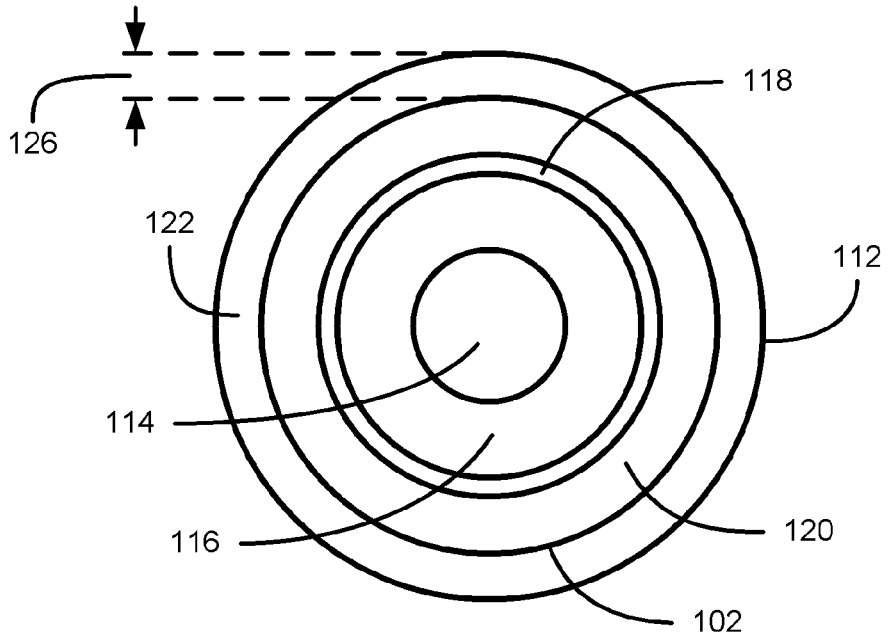
FIG. 4 is a cross-sectional view of an example embodiment of the choke and electrical cable taken through line 4-4 of FIG. 1.
Figure 5:
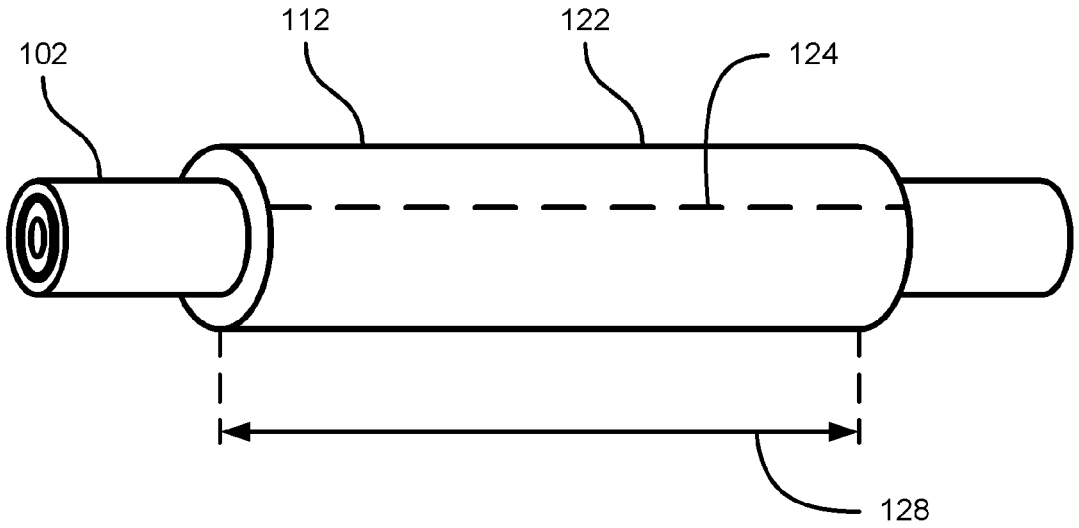
FIG. 5 is a perspective view of the choke and electrical cable of FIG. 4.

FIG. 4 is a cross-sectional view of an example embodiment of the choke 112 and electrical cable 102 taken through line 4-4 of FIG. 1. FIG. 5 is a perspective view of the choke 112 and electrical cable 102 of FIG. 4. The choke 112 can include an electro-conductive sleeve 122, which can be made of metal (e.g., copper) or other electro-conductive material. The sleeve 122 can have a generally cylindrical shape, and can have a generally circular cross-sectional shape, although other cross-sectional shapes are possible (e.g., rectangular or other polygonal shapes). As shown in FIGS. 4 and 5, the sleeve 122 can extend around the full cross-sectional perimeter of the electrical cable 102, although in some embodiments, the electro-conductive sleeve 122 can extend around less than the full cross-sectional perimeter of the electrical cable 102, as discussed herein. The electro-conductive sleeve 122 can be a seamless sleeve, which can be, for example, an extruded piece of electro-conductive material (e.g., copper). In some embodiments, the electro-conductive sleeve 122 can include a seam 124 (shown by a dotted line in FIG. 5), which can extend substantially parallel to the longitudinal axis of the sleeve 122. For example, the sleeve 122 can be formed by bending a generally planar piece of electro-conductive material (e.g., copper) so that the ends of the piece of material are adjacent or near each other. The ends can be joined by an electro-conductive material such as solder, an electro-conductive adhesive, etc., or by an insulating material, as discussed herein. In some embodiments, the electro-conductive sleeve 122 can be a coating applied to the outside of the electrical cable 102 (e.g., a electro-conductive paint or an electro-conductive tape).

The electro-conductive sleeve 122 can have a thickness 126, which can be substantially uniform across the sleeve 122. In some embodiments, the electro-conductive sleeve 122 can be thin, but can have sufficient thickness such that the sleeve 122 is electro-conductive. The thickness 126 of the sleeve 122 can vary depending on the frequency or wavelength of the signal being suppressed. For example, the sleeve 122 can have a thickness of at least about 2 skin depths, at least about 3 skin depths, at least about 4 skin depths, at least about 5 skin depths, at least about 7 skin depths, at least about 10 skin depths, or more, and the sleeve 122 can have a thickness 126 of no more than about 20 skin depths, no more than about 15 skin depths, no more than about 10 skin depths, no more than about 7 skin depths, no more than about 5 skin depths, or less. Depending on the target frequencies or wavelengths to suppress, the thickness 126 can be less than about 2 mm, less than about 1 mm, less than about 0.5 mm, less than about 0.25 mm, less than about 0.1 mm, or less, and the thickness 126 can be at least about 0.01 mm, at least about 0.05 mm, at least about 0.075 mm, at least about 0.1 mm, at least about 0.15 mm, at least about 0.2 mm, at least about 0.5 mm, or more, although other values can be used depending on the frequencies or wavelengths of the signals being suppressed. Other thicknesses outside of these ranges can also be used for the electro-conductive sleeves 112 disclosed herein.

Figure 6:
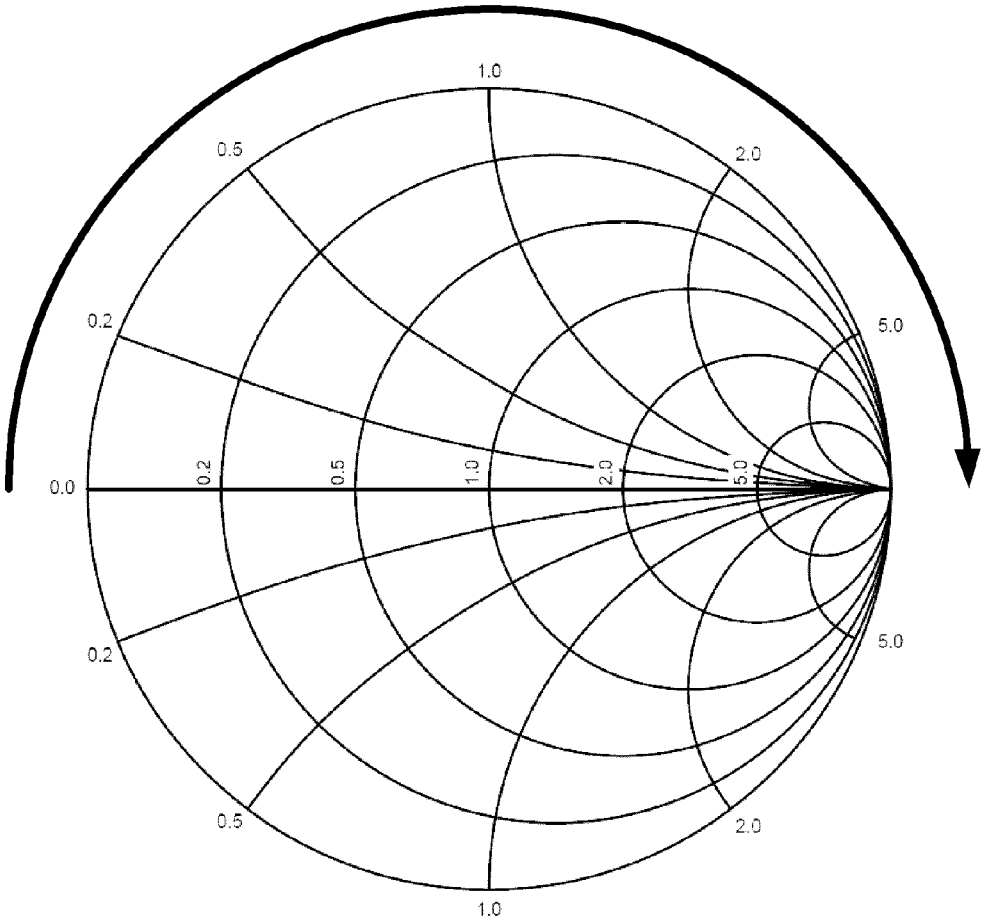
FIG. 6 is a smith chart showing example behavior of an example embodiment of a quarter-wave choke.

The electro-conducive sleeve 122 can have a length 128, which can correspond to the frequency or wavelength of the signal being suppressed. Various features and embodiments disclosed herein can relate to quarter-wave chokes. A quarter-wave choke can include a electro-conductive sleeve 122 having a length 128 of about one-fourth (0.25) the wavelength of the undesired signal being suppressed. The electro-conductive sleeve 122 of a quarter-wave choke can have a first end (e.g., the end furthest from the source (e.g., the electrical component 104)) that is shorted (e.g., electrically coupled to the shielding layer 118) and a second end (e.g., the end closest the source (e.g., the electrical component 104)) that is open (e.g., not electrically coupled to the shielding layer 118). In this configuration, the sleeve 122 can behave, or be referred to, as a quarter-wave resonator at the frequency or wavelength of the signal being suppressed. As shown in FIG. 6, the behavior of an example quarter-wave choke can be illustrated on the Smith chart by starting at zero ohms and rotating one quarter wavelength towards the generator, or half a rotation around the Smith chart, arriving at infinity. This configuration can produce a desired high impedance, thereby effectively suppressing (e.g., blocking or attenuating) the undesired current (e.g., which can travel in the shielding layer 118).

In some embodiments, the length 128 of the sleeve 122 in a quarter-wave choke does not exactly equal one-fourth (0.25) the wavelength of the signal being suppressed. For example, if the electrical cable 102 has an insulating outer jacket 120, the velocity of propagation of the signal can be reduced, which can result in an optimal sleeve length 128 of less than one-fourth (0.25) the wavelength of the signal being suppressed. Also, in some instances, there can be fringing fields at the open and/or shorted ends of the electro-conductive sleeve, which can also modify the resonant length of the choke, which can result in an optimal sleeve length 128 that is different than one-fourth (0.25) the wavelength of the signal being suppressed. As used herein the terms "quarter-wave choke" and "quarter-wave sleeve" refer to chokes and sleeves that operate on the principles described above (e.g., an electro-conductive sleeve 122 that is open on a first end and shorted to the electrical cable 102 on the second end and/or behaving as a quarter-wave resonator), even though the actual length 128 of the electro-conductive sleeve 122 can vary depending on, for example, the thickness of the outer jacket 120, the dielectric constant of the outer jacket 120, and/or properties of the sleeve itself, such that the length 128 of the sleeve 122 is not equal to one-fourth (0.25) of the wavelength of the signal being suppressed.

Figure 7:
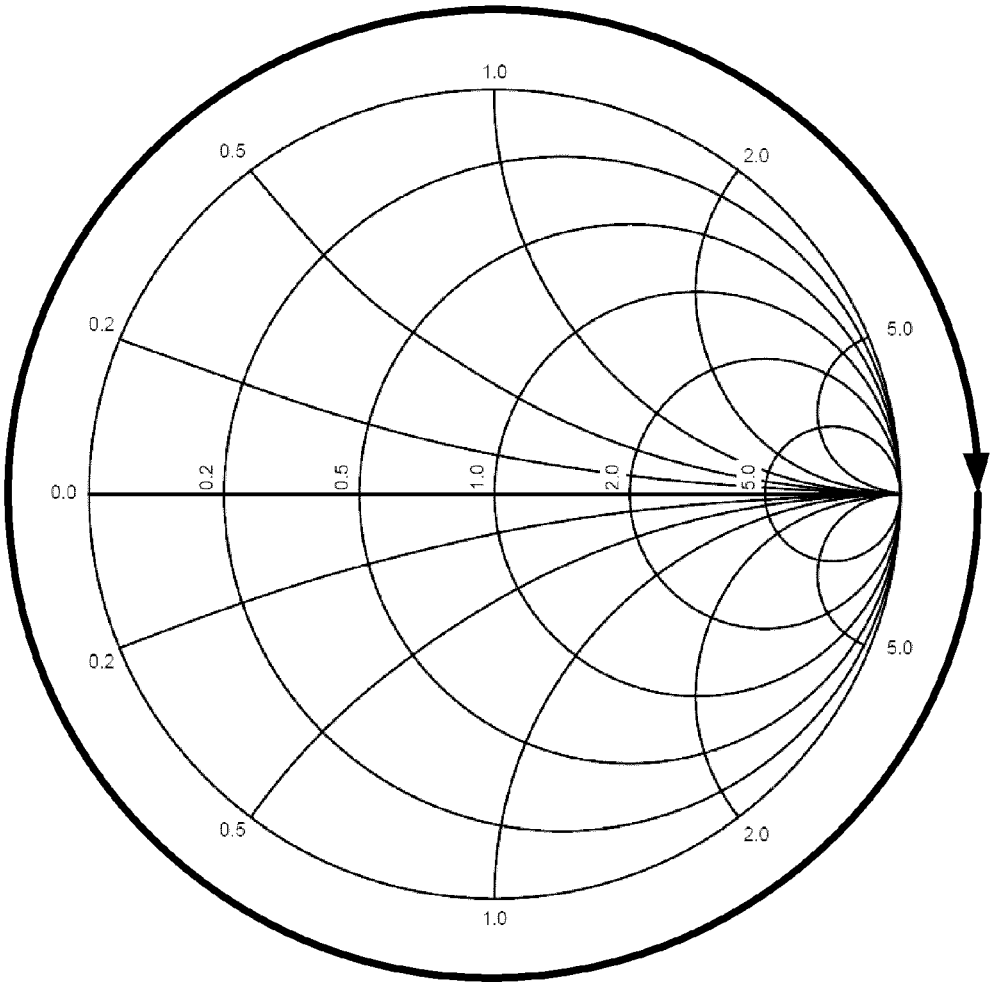
FIG. 7 is a smith chart showing example behavior of an example embodiment of a half-wave choke.

Various features and embodiments disclosed herein can relate to half-wave chokes. A half-wave choke can include an electro-conductive sleeve 122 having a length 128 of about half (0.5) the wavelength of the undesired signal being suppressed. The electro-conductive sleeve 122 of a half-wave choke can have a both ends open (e.g., neither end electrically coupled to the shielding layer 118 of the electrical cable 102). With neither end shorted, the electro-conductive sleeve 122 can behave, or be referred to, as a half-wave resonator at the frequency or wavelength of the signal being suppressed. As shown in FIG. 7, the behavior of an example half-wave choke can be illustrated on the Smith chart by starting at infinity and rotating one half wavelength towards the generator, or a full rotation around the Smith chart, arriving back at infinity. This configuration can produce a desired high impedance, thereby effectively suppressing (e.g., blocking or attenuating) the undesired current (e.g., which can travel in the shielding layer 118).

In some embodiments, the length 128 of the sleeve 122 in a half-wave choke does not exactly equal half (0.5) the wavelength of the signal being suppressed. For example, if the electrical cable 102 has an insulating outer jacket 120, the velocity of propagation of the signal can be reduced, which can result in an optimal sleeve length 128 of less than half (0.5) the wavelength of the signal being suppressed. Also, in some instances, there can be fringing fields at one or both of the open ends of the electro-conductive sleeve 122, which can also modify the resonant length of the choke, which can result in an optimal sleeve length 128 that is different than half (0.5) the wavelength of the signal being suppressed. As used herein the terms "half-wave choke" and "half-wave sleeve" refer to chokes and sleeves that operate on the principles described above (e.g., an electro-conductive sleeve 122 that is open at both ends and/or behaving as a half-wave resonator), even though the actual length 128 of the electro-conductive sleeve 122 can vary depending on, for example, the thickness of the outer jacket 120, the dielectric constant of the outer jacket 120, and/or properties of the sleeve itself, such that the length 128 of the sleeve 122 is not equal to half (0.5) of the wavelength of the signal being suppressed.

A quarter-wave choke can include less material than a half-wave choke that is configured to suppress a signal of the same frequency or wavelength. However, the half-wave choke can be advantageous because it does not include any electrical connection to the electrical cable 102 (e.g., to the shielding layer 118 thereof). One advantage of a half-wave choke that does not include an electrical connection to the electrical cable 102 is reduced labor and cost associated with removing the outer jacket 120 and connecting the sleeve 122 to the shielding layer 118 of a electrical cable 102. Another advantage of a half-wave choke that does not include an electrical connection to the electrical cable 102 is improved compatibility as compared to a quarter-wave choke. For example, a half-wave choke can be used with electrical cables for which a quarter-wave choke would be impossible, impractical, or difficult (e.g., electrical cables other than coaxial cables and electrical cables that do not include a shielding layer 118). Another advantage of a half-wave choke that does not include an electrical connection to the electrical cable is that half-wave choke can be more easily installed on existing electrical systems (e.g., in a retrofitting process).

Figure 8:
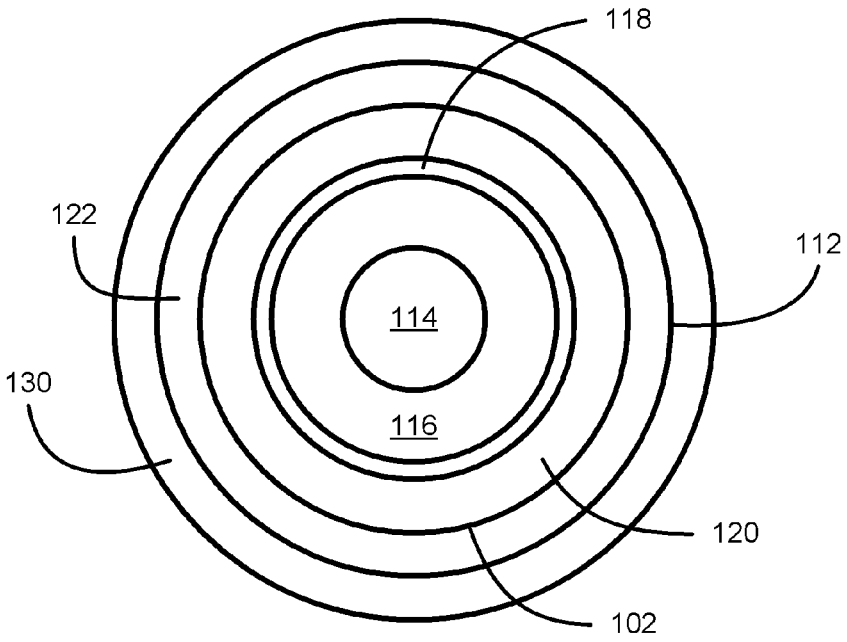
FIG. 8 is a cross-sectional view of another example embodiment of a choke coupled to an electrical cable.
Figure 9:
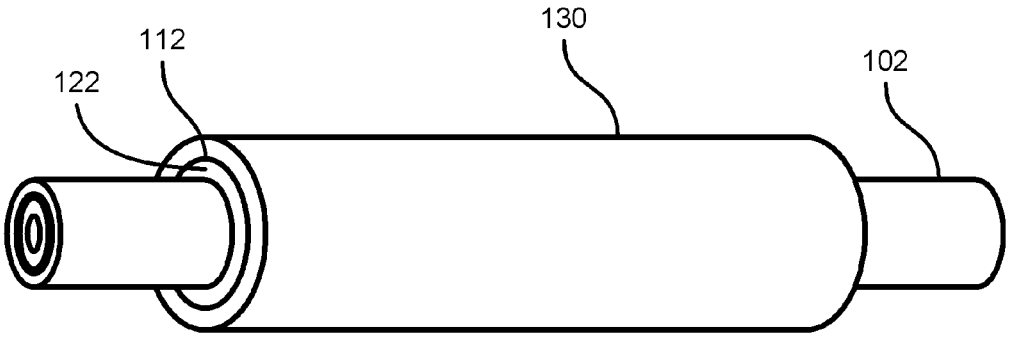
FIG. 9 is a perspective view of the choke and electrical cable of FIG. 8.

FIG. 8 is a cross-sectional view of an example embodiment of a choke 112 coupled to an electrical cable 102. FIG. 9 is a perspective view of the choke 112 and electrical cable 102 of FIG. 8. In some embodiments, an outer insulating layer 130 can be disposed over the electro-conductive sleeve 122. The outer insulating layer 130 can provide electrical insulation or protection from the environment. The outer insulating layer 130 can be made of an insulating material (e.g., FEP). The various insulating materials discussed herein can be dielectric materials. Various embodiments disclosed herein can optionally include the outer insulating layer 130 disposed over the choke 112, even when not shown or specifically discussed. In some figures, the outer insulating layer 130 is omitted from view to facilitate viewing of other features. In some embodiments, the outer insulating layer 130 can be omitted. As shown in FIG. 9, the outer insulating layer 130 can have generally the same length as the electro-conductive sleeve 122, although in some embodiments the outer insulating layer 130 can extend past one or both ends of the electro-conductive sleeve 122. For example the material of the outer insulating layer 130 can cover the ends of the sleeve 122, and in some embodiments, the material of the outer insulating layer 130 can contact the electrical cable 102 (e.g., the outer jacket 120).

Figure 10:
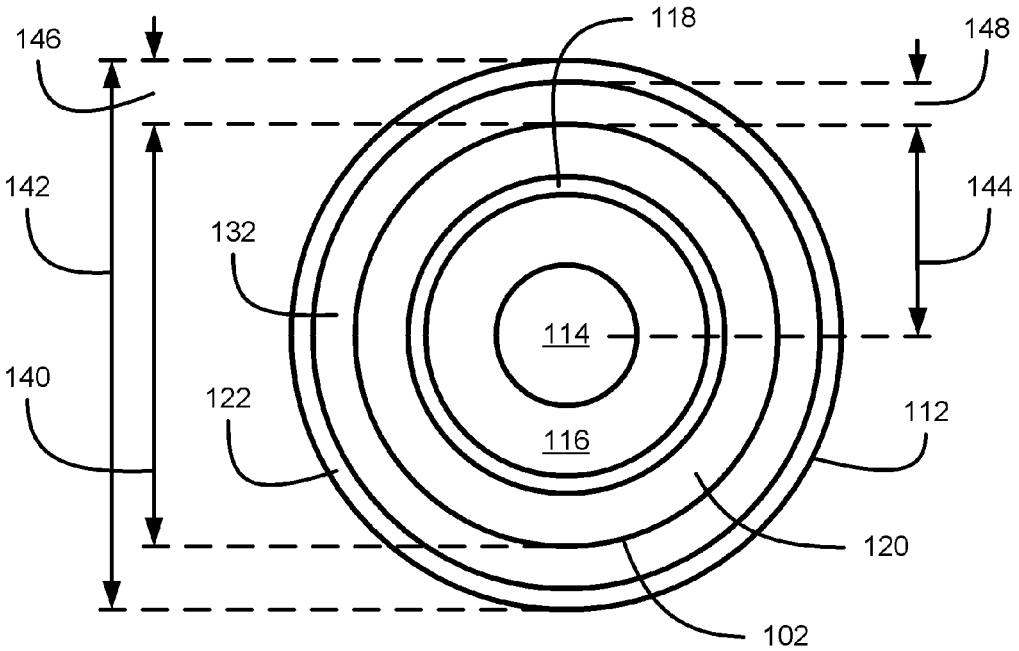
FIG. 10 is a cross-sectional view of another example embodiments of a choke coupled to an electrical cable.
Figure 11:
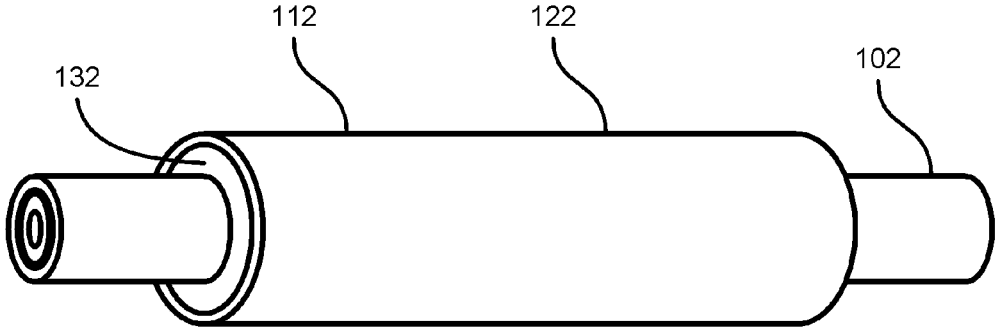
FIG. 11 is a perspective view of the choke and electrical cable of FIG. 10.

FIG. 10 is a cross-sectional view of an example embodiments of a choke 112 coupled to an electrical cable 102. FIG. 11 is a perspective view of the choke 112 and electrical cable 102 of FIG. 10. Additional insulating (e.g., dielectric) material 132 can be disposed under the electro-conductive sleeve 122. The additional insulating material 132 can be disposed between the sleeve 122 and the outer surface of the electrical cable 102 (e.g., the outer surface of the outer jacket 120). In some embodiments, the additional insulating material 132 can be applied (e.g., coated or wrapped) over the outer surface of the electrical cable 102 before the electro-conductive sleeve 122 is applied thereto, or the additional insulating material 132 can be applied to an inside of the electro-conductive sleeve 122 and the sleeve 122 and additional insulating material 132 can be applied together over the electrical cable 102. The additional insulating material can be a layer of FEP, although other insulating materials can also be used.

As discussed above, in some cases, the electrical cable 102 can be covered in an outer jacket 120, which can include an insulating (e.g., dielectric) material such as fluorinated ethylene propylene (FEP), and properties of the outer jacket 120 (e.g., the dielectric constant and the thickness of the outer jacket 120) can be considered in optimizing the length of the electro-conductive sleeve 122. In some instances, a thicker outer jacket 120 can result in a shorter sleeve length 128. The additional insulating material 132 can have the effect of increasing the outer jacket 120 of the cable 102 at the portions of the cable 102 under the electro-conductive sleeve 122. Accordingly, including additional insulating material 132 can allow for a shorter sleeve length 128, which can use less conductive material and can encumber less of a length of the electrical cable 102. The additional insulating material 132 can enable the choke 112 (e.g., a half-wave choke) to provide more favorable suppression of common mode EMI and/or RFI and/or other currents (e.g., by increasing the amount of suppression of undesired signals). In some embodiments, the additional insulating material 132 can also increase the effective frequency range of the choke 112. Various embodiments are discussed herein in connection with suppression of a target frequency or wavelength or a range of frequencies or wavelengths. In some cases, a choke 112 can be configured to optimize suppression of a signal of a particular frequency or wavelength, and signals of other nearby frequencies or wavelengths can also be suppressed by the same choke 112. For example, in various embodiments a plot of the amount of suppression provided by a choke 112 across various wavelengths or frequencies can have a curved distribution with different amounts of suppression for different wavelengths or frequencies, and in some cases a maximum amount of suppression can be achieved for a particular frequency or wavelength, sometimes referred to herein as a target frequency or wavelength. Many variations are possible, for example, in some cases the distribution of signal suppression may not have a well-defined maximum, and the target frequency or wavelength may be a particular frequency or wavelength for which the choke is configured to provide significant signal suppression even if not at a well-defined maximum of the distribution of signal suppression. Some features discussed herein are configured to increase an amount of suppression, which can result in more signal suppression for the target wavelength or frequency. In some cases, an increase in the amount of suppression applied to the target wavelength or frequency can also result in an increase of a frequency or wavelength range of effective suppression of a choke 112.

Figure 12:
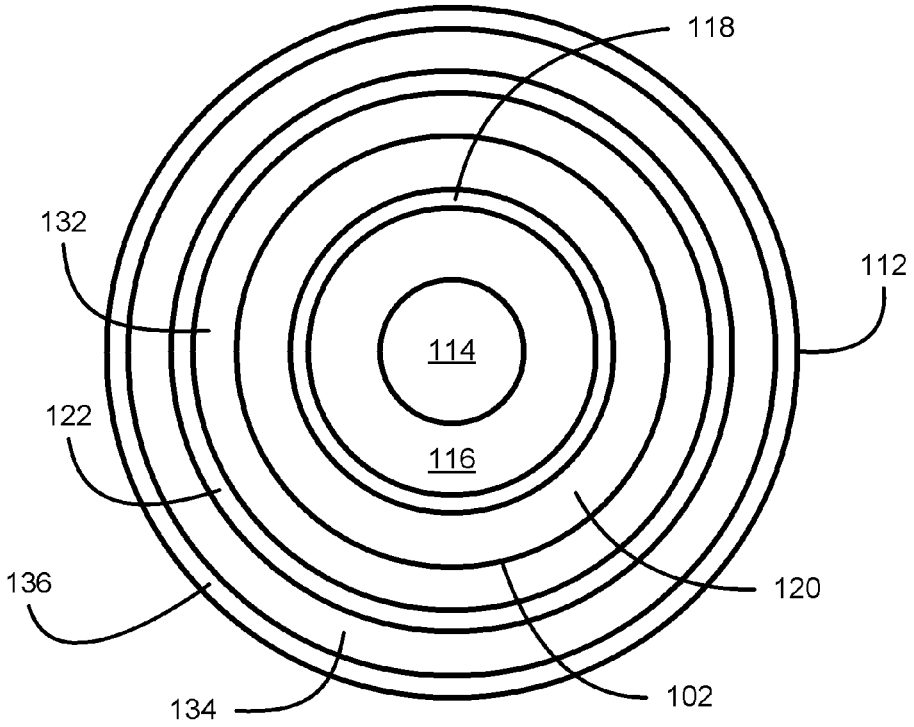
FIG. 12 is a cross-sectional view of another example embodiment of a choke coupled to an electrical cable.
Figure 13:
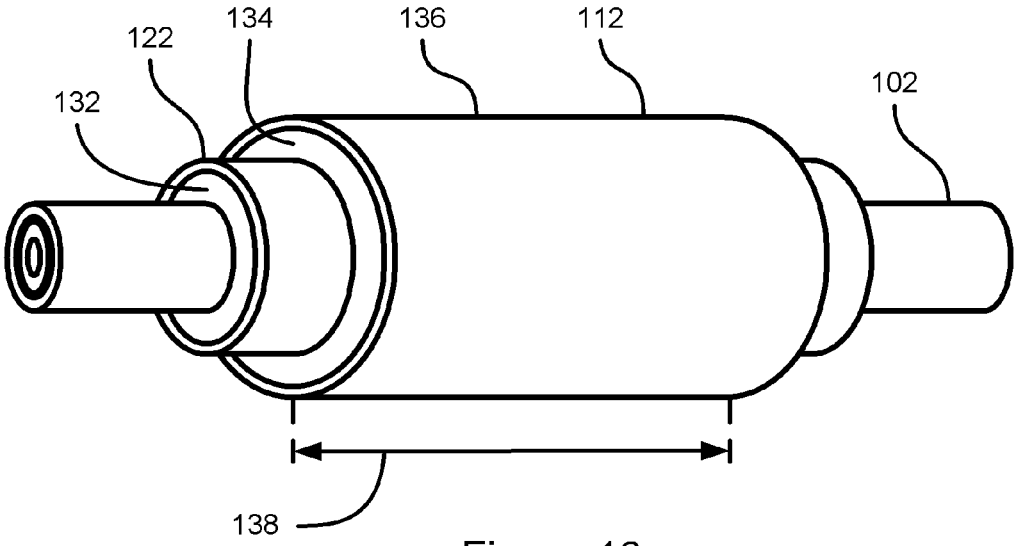
FIG. 13 is a perspective view of the choke and electrical cable of FIG. 12.

FIG. 12 is a cross-sectional view of an example embodiment of a choke 112 coupled to an electrical cable 102. FIG. 13 is a perspective view of the choke 112 and electrical cable 102 of FIG. 12. In some embodiments, the choke 112 can include a second electro-conductive sleeve 136 disposed over the first electro-conductive sleeve 122. The sleeves 136 and 122 can be disposed substantially concentrically. In some embodiments additional insulating material 132 can be disposed under the first electro-conductive sleeve 122 (e.g., as shown in FIGS. 12 and 13), although, in some embodiments, the additional insulating material 132 can be omitted. An insulating layer 134 can be disposed over the first electro-conductive sleeve 122, under the second electro-conductive sleeve 136, and/or between the first and second electro conductive sleeves 122 and 136. The insulating layer 134 can be made of an insulating (e.g., dielectric) material such as FEP. The insulating layer 134 can have a thickness and/or other features that are similar to the layer of additional insulating material 132 discussed herein.

The first electro-conductive sleeve 122 (e.g., the length 128 thereof) and the second electro-conductive sleeve 136 (e.g., the length 138 thereof) can both be configured to suppress undesired signals. The first electro-conductive sleeve 122 can be configured to suppress a first frequency or wavelength range of signals, and the second electro-conductive sleeve 136 can be configured to suppress a second frequency or wavelength range of signals. The first range of signals (suppressed by the first sleeve 122) can overlap with the second range of signals (suppressed by the second sleeve 136), although in some embodiments, the first and second ranges do not overlap. In some embodiments, the sleeves 122 and 136 can be configured to suppress substantially the same frequency or wavelength range of signals. In some embodiments the second electro-conductive sleeve 136 can increase the effective frequency or wavelength range of the choke 112. Sleeves 122 and 135 of various lengths can be used to provide various different types of signal suppression. The use of multiple sleeves 122 and 136 can effectively increase the frequency or wavelength range of the choke 112. The electro-conductive sleeves 122 and 136 can be quarter-wave sleeves, half-wave sleeves, or a combination thereof. In some embodiments, the sleeves 122 and 136 can operate as coupled resonators (e.g., not independent resonators). In some embodiments, the sleeves 122 and 136 can be mutually coupled to the electrical cable 102 to facilitate suppression of undesired signals.

In some embodiments, the optimal length 128 for the sleeve 122 can be affected by properties of the sleeve 136, the insulating layer 134, the additional insulating (e.g., dielectric) material 132, the outer jacket 120, and/or the sleeve 122. For example, for a half-wave chokes, the actual length 128 of the sleeve 122 can be different (e.g., larger or smaller) than half (0.5) the wavelength (e.g., the free space wavelength) of the signal being suppressed. In some embodiments, the optimal length 138 for the sleeve 136 can be affected by properties of the sleeve 136, the insulating layer 134, the additional insulating (e.g., dielectric) material 132, the outer jacket 120, and/or the sleeve 122. For example, for a half-wave chokes, the actual length 138 of the sleeves 136 can be different (e.g., larger or smaller) than half (0.5) the wavelength of the signal being suppressed.

As shown in FIGS. 12 and 13, the choke 112 can included two electro-conductive sleeves 122 and 136. In some embodiments, additional electro-conductive sleeves (not shown) can be added to suppress additional signals or ranges of signals, or to enhance suppression of the signals suppressed by the sleeves 122 and/or 136. For example, in some embodiments, three, four, five, or more sleeves can be used. In some embodiments, three electro-conductive sleeves can be used (e.g., positioned to be substantially concentric), and the three sleeves can be configured to suppress various frequency ranges, although more than three sleeves can be used in some embodiments. The length 138 of the second sleeve 136 can have a shorter than the length 128 of the first sleeve 122. In some embodiments, each sleeve can have a length that is shorter than the length(s) of the sleeve(s) disposed thereunder. In some embodiments, a sleeve can have a length that is longer than one or more sleeves disposed thereunder. For example, the length 138 of the second sleeve 136 can be longer than the length 128 of the first sleeve 128, and in some cases conductive material can extend substantially between the outside surface of the electrical cable 102 and the second sleeve 136 at the areas where the second sleeve 136 overlaps the first sleeve 122.

Including additional insulating material 132 and/or including one or more additional electro-conductive sleeves 136 (e.g., positioned to be concentric with the sleeve 122 and/or the electrical cable 102), as discussed in connection with FIGS. 10-13, can increase the thickness 146 and outer diameter 142 of the choke 112. In some implementations, it can be advantageous to limit the thickness 146 and/or outer diameter 142 of the choke 112. For example, in some implementations, if the choke 112 has a large thickness 146 and/or outer diameter 142, the choke 112 may interfere with other features of the electrical system 100. In some cases, the choke 112 may appear to suppress the current returning back along the electrical cable 102 (e.g., along the outer jacket 120 or shielding layer 118), but in fact, due to the large thickness 146 and/or outer diameter 142, the choke 112 may block the RF radiation that radiates from the electrical component 104 (e.g., antenna element) to which the electrical cable 102 is connected.

Various dimensions are described in connection with FIG. 10, although the described dimensions can relate to various embodiments disclosed herein (e.g., to the choke configurations of FIGS. 4-5 and 8-26). The electrical cable 102 can have an outer diameter 140. The outer diameter 140 of the electrical cable 102 can be substantially equal to an inner diameter of the choke 112. The choke 112 can have an outer diameter 142 that is less than or equal to about 3 times the outer diameter 140 of the electrical cable, less than or equal to about 2.5 times the outer diameter 140 of the cable, less than or equal to about 2 times the outer diameter 140 of the cable 102, less than or equal to about 1.5 times the outer diameter 140 of the cable 102, less than or equal to about 1.25 times the outer diameter 140 of the cable 102, or less than or equal to about 1.1 times the outer diameter 140 of the cable 102. The outer diameter 142 of the choke can be greater than or equal to about 1.05 times the outer diameter 140 of the cable 102, greater than or equal to about 1.1 times the outer diameter 140 of the cable 102, greater than or equal to about 1.25 times the outer diameter 140 of the cable 102, greater than or equal to about 1.5 times the outer diameter 140 of the cable 102, greater than or equal to about 2 times the outer diameter 140 of the cable 102. The outer diameter 142 of the choke 112 can be between about 1.25 to about 3 times the outer diameter 140 of the cable 102, from about 1.5 to about 2.5 times the outer diameter 140 of the cable 102, from about 1.75 to about 2.25 times the outer diameter 140 of the cable 102, from about 1.25 to about 2 times the outer diameter 140 of the cable 102, about 1.5 to about 2 times the outer diameter 140 of the cable 102, or from about 1.75 to about 2 times the outer diameter 140 of the cable 102. Various dimensions outside these ranges are also possible, in some embodiments.

The electrical cable 102 can have an outer radius 144, which can be substantially equal to an inner radius of the choke 112. The choke 112 can have a thickness 146 that is less than or equal to about 1.5 times the outer radius 144 of the cable 102, less than or equal to about 1.25 times the outer radius 144 of the cable 102, less than or equal about 100% of the outer radius 144 of the cable 102, less than or equal to about 75% of the outer radius 144 of the cable 102, less than or equal to about 50% of the outer radius 144 of the cable 102, or less than or equal to about 25% of the outer radius 144 of the cable 102. The thickness 146 of the choke 112 can be greater than or equal to about 10% of the outer radius 144 of the cable 102, greater than or equal to about 25% of the outer radius 144 of the cable 102, greater than or equal to about 50% of the outer radius 144 of the cable 102, greater than or equal to about 75% of the outer radius 144 of the cable 102, or greater than or equal to the outer radius 144 of the cable 102. Various dimensions outside these ranges are also possible, in some embodiments.

In embodiments that include additional insulating material 132 (e.g., disposed under the sleeve 122 and over the outer jacket 120 of the cable 102), the additional insulating material 132 can have a thickness 148 that is less than or equal to about 1.25 times the outer radius 144 of the cable 102, less than or equal to about 100% of the outer radius 144 of the cable 102, less than or equal to about 75% of the outer radius 144 of the cable 102, less than or equal to about 50% of outer radius 144 of the cable 102, less than or equal to about 25% of the outer radius 144 of the cable 102, or less than or equal to about 10% of ter radius 144 of the cable 102. The thickness 148 of the additional insulating material 132 can be greater than or equal to about 5% of the outer radius 144 of the cable 102, greater than or equal to about 10% of the outer radius 144 of the cable 102, greater than or equal to about 25% of the radius 144 of the cable 102, greater than or equal to about 50% of the outer radius 144 of the cable 102, or greater than or equal to about 75% of the outer radius 144 of the cable 102. Various dimensions outside these ranges are also possible, in some embodiments.

The properties of the additional insulating material 132 (e.g., thickness 148 and type of material) and/or the properties of the one or more additional electro-conductive sleeves 136 (e.g., sleeve length 138, sleeve thickness, and sleeve material) an affect the effective frequency range of the choke 112 and the amount of suppression that is applied to the signal being suppressed. Accordingly, these parameters can be adjusted to achieve a desired effective frequency or wavelength range for the choke 112. These parameters can also be adjusted to achieve a desired amount of signal suppression. In some cases, the amount of signal suppression can be measured as a ratio of the amount of current of the undesired signal (e.g., propagating along the shielding layer 118) on a first side of the choke 112 (e.g., before the current reaches the choke 112) to the amount of current of the undesired signal on a second side of the choke (e.g., after the current passes the choke 112). If the choke 112 did not suppress the current, the ratio would be one to one. Increased signal suppression results in a higher ratio of the current on the first side of the choke 112 to the current on the second side of the choke 112. In some embodiments, the amount of suppression applied of the undesired signal can be measured as the ratio of the amount of current that is present external to the electrical cable 102 (e.g., propagating in the choke 112) to the amount of undesired current that is propagating in the electrical cable 102 (e.g., in the shielding layer 118 or insulating layers 116 and/or 120 of the cable 102). In some embodiments, chokes 112 disclosed herein can be used to block between about 50% and about 96%, between about 60% and about 80%, between about 50% and about 60% of the undesired current, although various other amounts of the undesired current can be blocked.

In some embodiments, the choke 112 can be configured to suppress passive intermodulation (PIM). PIM can occur, for example, when two or more signals (e.g., high power tones) mix at device nonlinearities. The nonlinearities can be caused by junctions between dissimilar metals, between coaxial cables, between connectors, between mounting hardware, between like metals that are not atomically clean, etc. PIM can occur, for example, in multi-frequency communication systems (e.g., antenna arrays, land mobile radio sites, and/or satellite earth stations), where multiple signals (e.g., high power signals) of different frequencies are produced. Various example embodiments of chokes 112 disclosed herein can be configured to not produce PIM, or to produce low amounts of PIM as compared to other types of signal suppressors (e.g., ferrite beads). For example, the choke 112 can include substantially no nonlinearities. In some embodiments, the electro-conductive sleeve 122 can be a continuous piece of material that extends around a full cross-sectional perimeter of the electrical wire 102. For example, the electro-conductive sleeve 122 can be seamless, and the sleeve 122 can be an extruded or drawn piece of tubing. In some embodiments, the electro-conductive sleeve 122 can include substantially no nonlinearities. Accordingly, in some embodiments, the chokes 112 described in connection with FIGS. 4-5 and 8-13 can be configured to suppress PIM.

In some cases, an electro-conductive sleeve 122 can be formed by an electro-conductive (e.g., metal) layer that is wrapped around the cable 102, and in some cases the sleeve 122 can include a seam 124 (as shown in FIG. 5). In some cases, the junction between the ends of the electro-conductive layer (e.g., at the seam 124) can produce PIM. The linearity of the junction (e.g., the seam 124) can increased by a conductive adhesive, solder, brazing, etc. used to join the ends of the electro-conductive layer to form the sleeve 122. In some embodiments, the sleeve 122 can be constructed with substantially no metallic contact, which can reduce PIM.

Figure 14:
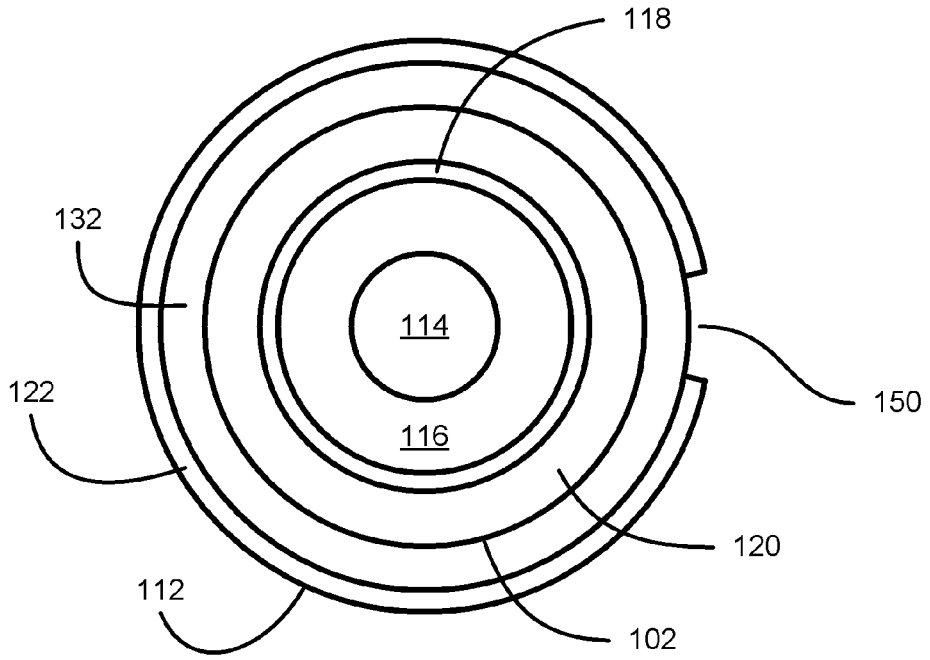
FIG. 14 is a cross-sectional view of another example embodiment of a choke coupled to an electrical cable.
Figure 15:
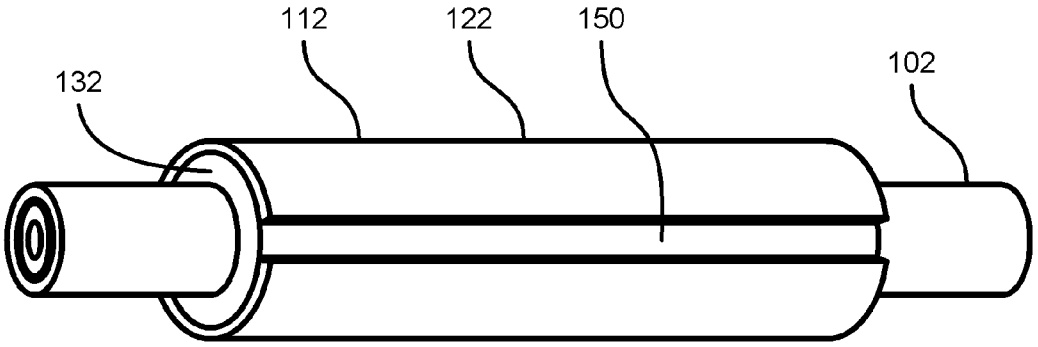
FIG. 15 is a perspective view of the choke and electrical cable of FIG. 14.
Figure 16:
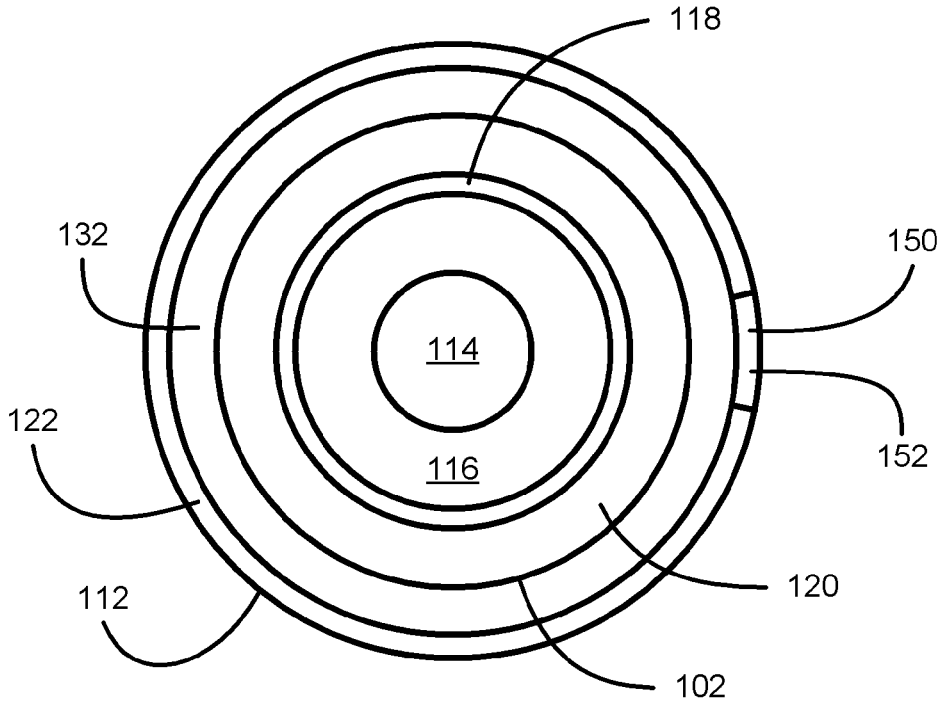
FIG. 16 is a cross-sectional view of another example embodiment of a choke coupled to an electrical cable.

FIG. 14 is a cross-sectional view of an example embodiment of a choke 112 coupled to an electrical cable 102. FIG. 15 is a perspective view of the choke 112 and electrical cable of FIG. 14. In some embodiments, the ends of the electro-conductive layer that forms the sleeve 122 can be spaced apart from each other such that no electrical contact is made between the ends. A slot 150 (e.g., a longitudinal slot) can extend between the ends of the electro-conductive sleeve 122, and the slot 150 can extend generally parallel to the longitudinal axis of the choke 112 and/or of the cable 102. Various sleeves disclosed herein (e.g., quarter-wave sleeves and half-wave sleeves for chokes of various different configurations) can be modified to include a slot 150 to produce chokes that are effective to suppress EMI and/or RFI and are also configured to suppress PMI. In some embodiments, the slot 150 can extend the full longitudinal length, or substantially the full longitudinal length, of the sleeve 122, as shown in FIG. 15. In some embodiments, the slot 150 can extend less than the full length of the sleeve 122. For example, the slot can extend a distance of at least about 25%, at least about 50%, at least about 75%, at least about 85%, at least about 90%, at least about 95%, at least about 98%, or more of the full length of the sleeve 122. In some embodiments, the slot 150 can extend a distance of 99% or less, or 98% or less, or 95% or less, or 85% or less, or 75% or less, or 50% or less, of the full length of the sleeve 122. In some embodiments, a sleeve 122 can include a small coupling section (not shown) that extends between the opposing sides of the sleeve 122, which can facilitate securing of the sleeve 122 over the electrical cable 102. The slot 150 can have a small width, in some embodiments. For example, gap in the choke of about 10 mils can be sufficient. The width of the slot 150 can be large enough in some embodiments so as to substantially prevent current "arc" across the gap. The width of the slot 150 can be small enough that the choke 112 can effectively mitigate PIM and can also be configured to suppress undesired signals (e.g., as a ½ wave open ended choke configured to suppress EMI and/or PMI), as discussed herein. In some embodiments, the slot 150 can have a width from about 0.1 mm to about 1 mm, from about 0.25 mm to about 0.75 mm, of about 0.25 mm, or of about 0.5 mm, although other values (e.g., outside of these ranges) can also be used. The slot 150 can have a substantially uniform width across substantially the full length of the slot 150, although in some embodiments, the slot 150 can have a width that varies (e.g., tapers or osculates) across the length of the slot 150. In some embodiments, the slot 150 can have a substantially uniform width across at least about 25%, at least about 50%, at least about 75%, at least about 85%, at least about 90%, at least about 95%, at least about 98%, at least about 99%, or the full length of the slot 150, or across 99% or less, or 98% or less, or 95% or less, or 85% or less, or 75% or less, or 50% or less, or 25% or less of the full length of the slot 150.

Figure 17:
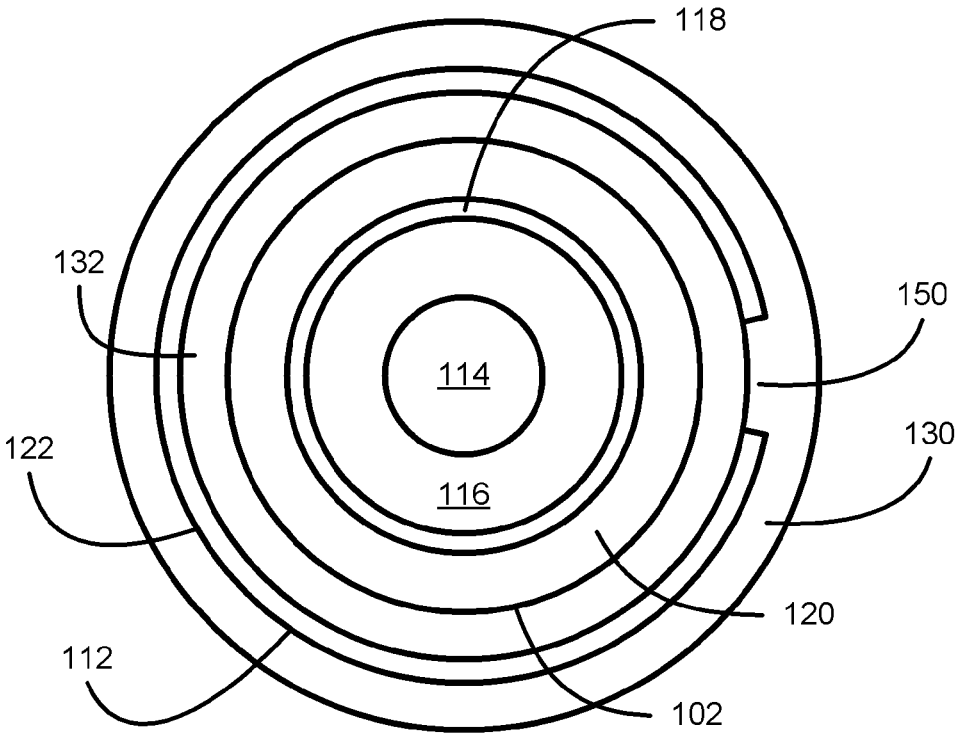
FIG. 17 is a cross-sectional view of another example embodiment of a choke coupled to an electrical cable.
Figure 18:
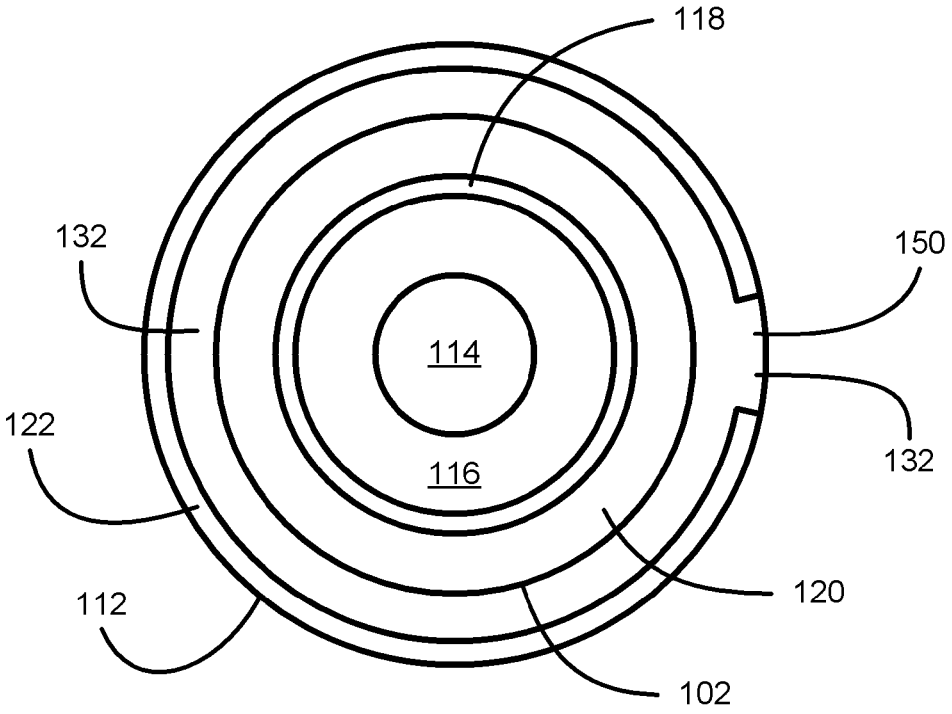
FIG. 18 is a cross-sectional view of another example embodiment of a choke coupled to an electrical cable.

In some embodiments, metallic contact causing PIM can be mitigated by use of a continuous sleeve such as seamless extruded or drawn tubing. In some embodiments, the sleeve 122 can be wrapped around the cable 102. The ends of the wrapped sleeve 122 can be spaced apart to form the slot 150. In some embodiments, the ends can be joined. For example, the ends of the sleeve 122 can be welded together, soldered together, or joined by a conducting adhesive, etc., in a manner that reduces or eliminates nonlinearities. In some embodiments soldering or welding, etc., can induce non-linearities that can be insubstantial. In some embodiments, the slot 150 can be at least partially filled with a material 152, which can be different than the material of the sleeve 122, as shown for example in FIG. 16. In some embodiments, a solder, or an adhesive material (e.g., a conductive adhesive), can be used to join or secure the ends of the sleeve 122 together. In some embodiments, a conductive material (e.g., a metal) can be used to join or secure one or more of the ends of the sleeve 122. In some embodiments, an insulating (e.g., dielectric) material (e.g., FEP or PVC) can join the ends of the sleeve 122 and/or can at least partially fill the slot 150 formed between the ends of the sleeve 122. In some embodiments, the slot 150 can be at least partially, of substantially completely, filled with air or other gaseous material. As shown in FIG. 17, in some embodiments, an outer insulating layer 130 (e.g., an outer jacket disposed over the choke 112) can have a portion that at least partially fills or substantially fills the slot 150. In some embodiments, the additional insulating material 132 (which can optionally be disposed between the sleeve 122 and the outer jacket 120 of the cable 102) can extend into the slot 150, as shown in FIG. 18. In some embodiments, the additional insulating material 132 can fill at least a part of or substantially the entire slot 150.

Figure 19:
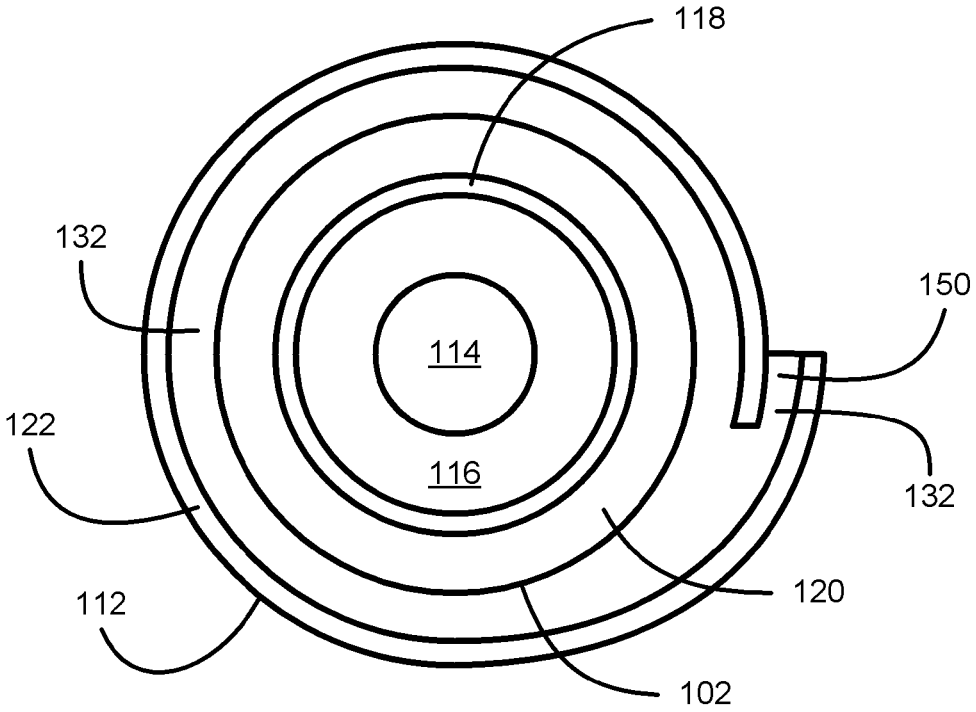
FIG. 19 is a cross-sectional view of another example embodiment of a choke coupled to an electrical cable.

In some embodiments, the ends of the sleeve 122 can overlap. An example embodiment of a choke 112 having a sleeve 122 with overlapping ends is shown in FIG. 19. An area near the second end of the sleeve 122 can be disposed over (radially outward of) an area near the first end of the sleeve 122. A slot 150 can be disposed between the overlapping end portions of the sleeve 122. In some embodiments, an electrically insulating (e.g., dielectric) material can be disposed between the overlapping end portions of the sleeve 122. For example, the additional insulating material 132 (which can optionally be disposed between the sleeve 122 and the outer jacket 120 of the cable 102) can extend into the slot 150 formed between the end portions of the sleeve 122. In some embodiments, the additional insulating material 132 can fill at least a part of or substantially the entire slot 150. An outer jacket (now shown in FIG. 19 can fill at least part of, or substantially the entire, slot 150. In some embodiments, material of an outer jacket (not shown) can extend into the slot 150 and can fill the slot 150 partially or substantially completely. In some embodiments, the end portions of the sleeve 122 are capacitively coupled (e.g., such that the end portions of the sleeve 122 can form, or operate as, a capacitor).

In some instances, the slot 150 can affect the performance of the choke 112 (as compared to a choke 112 without the slot 150), which can result in a different optimal sleeve length 128 (as compared to a choke 112 without the slot 150). Accordingly, properties of the slot 150 (e.g., the width of the slot 150 and the type of filling material) can be used in determining the length 128 for the sleeve 122, and in some cases re-optimization may be performed to account for the slot 150, filling material, and/or other features of the choke 112.

Figure 20:
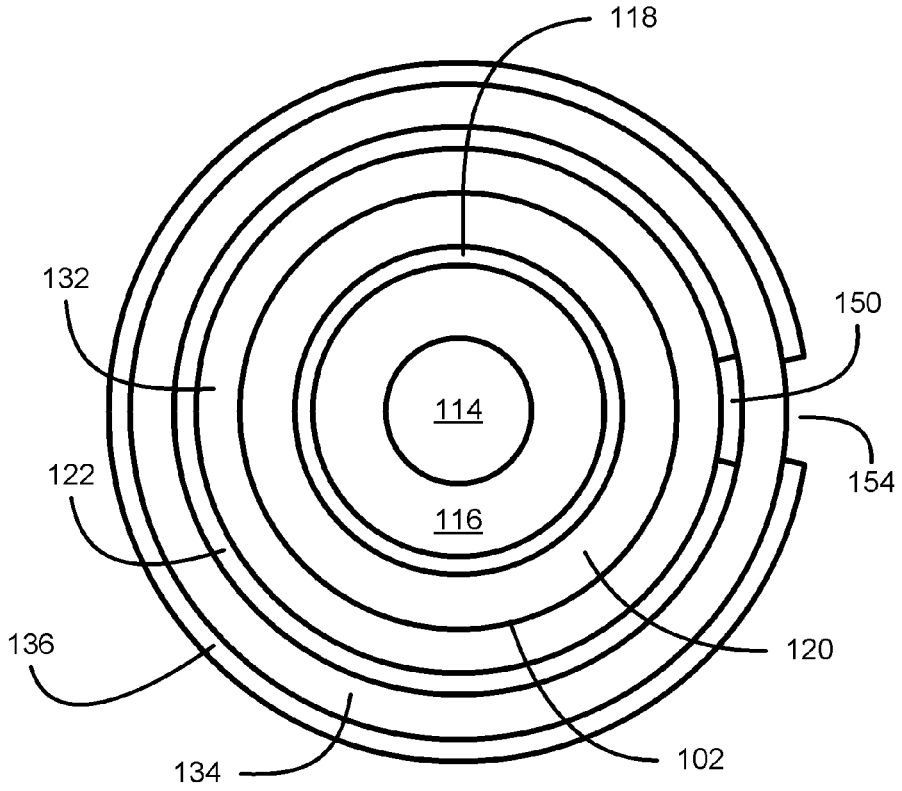
FIG. 20 is a cross-sectional view of another example embodiments of a choke applied to an electrical cable.
Figure 21:
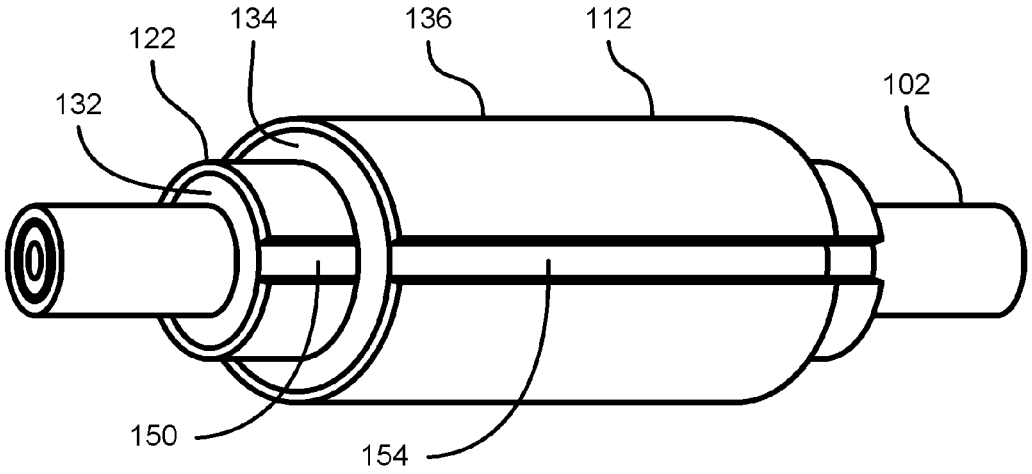
FIG. 21 is a perspective view of the choke and cable of FIG. 20.
Figure 22:
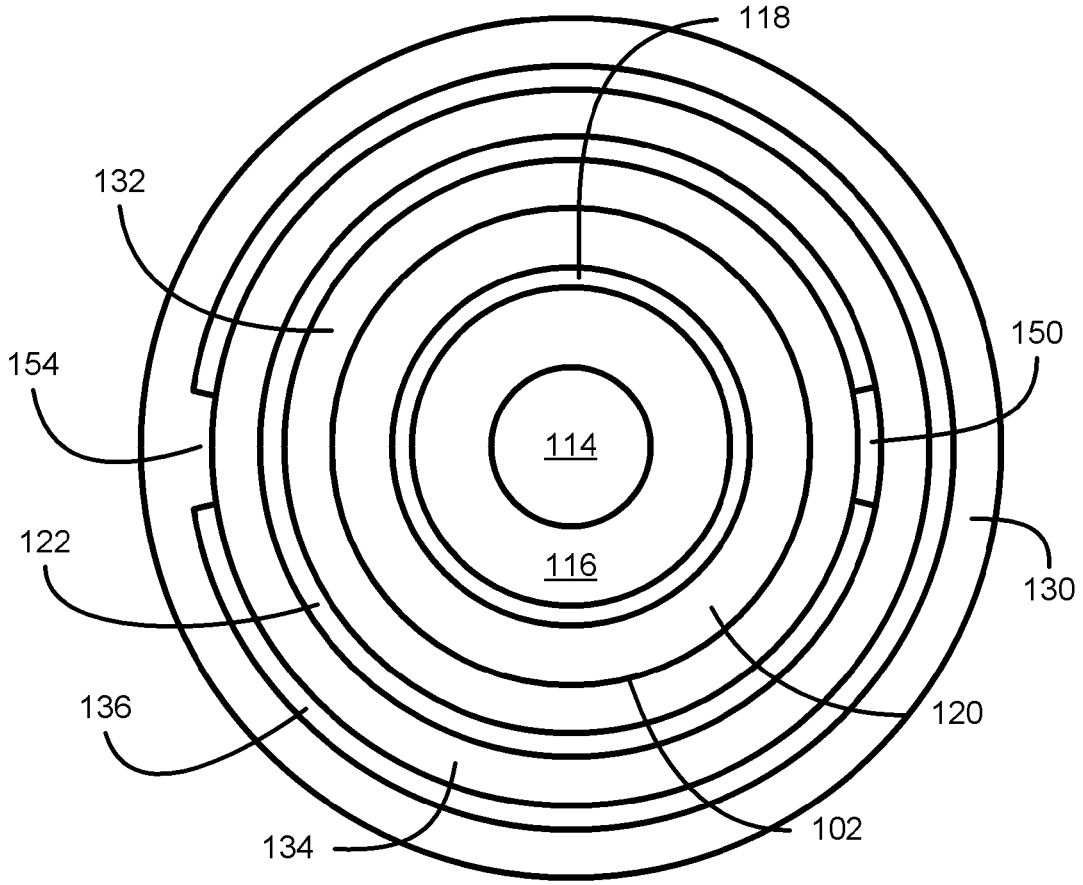
FIG. 22 is a cross-sectional view of another example embodiment of a choke coupled to an electrical cable.

FIG. 20 is a cross-sectional view of an example embodiments of a choke 112 applied to an electrical cable 102. FIG. 21 is a perspective view of the choke 112 and cable 102 of FIG. 20. The choke 112 of FIGS. 20-21 can have a configuration similar to the choke 112 of FIGS. 12-13, and features discussed on connection with FIG. 12-13 can be applied to the choke 112 of FIG. 21. The ends of the electro-conductive sleeves 122 and 136 can be separated by respective slots 150 and 154. The slot 154 can be similar to the slot 150 discussed herein, and features described in connection with the slot 150 can be applied to the slot 154 as well. The slots 150 and 154 can be disposed on substantially the same side of choke 112 (as shown in FIGS. 20-21) (e.g., having the slot 154 disposed over (e.g., substantially directly over) the slot 150). The slots 150 and 154 can be disposed on opposite sides of the choke 112 (as shown in FIG. 22), although various other relative positions for the slots 150 and 154 can be used. As shown in FIG. 22, material of an outer jacket 130 can extend into the slot 154, in some embodiments. The slot 154 can be partially or substantially completely filled with material of the outer jacket 130, material of the insulating layer 134, a separate insulating filling material, air, etc.

Figure 23:
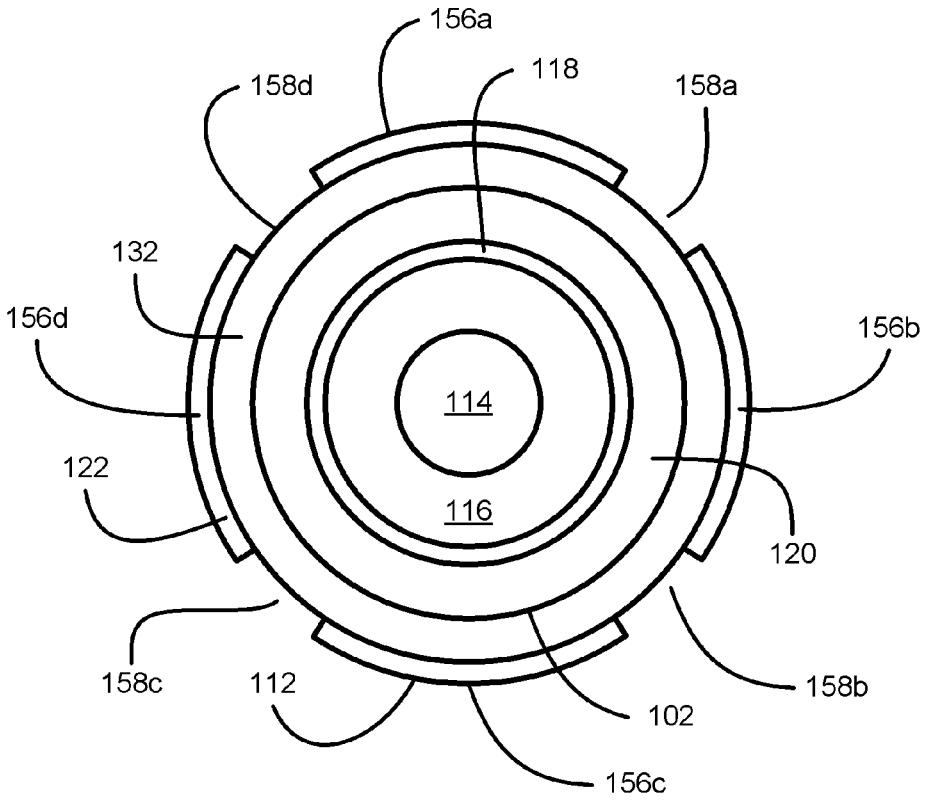
FIG. 23 is a cross-sectional view of another example embodiment of a choke coupled to an electrical cable.
Figure 24:
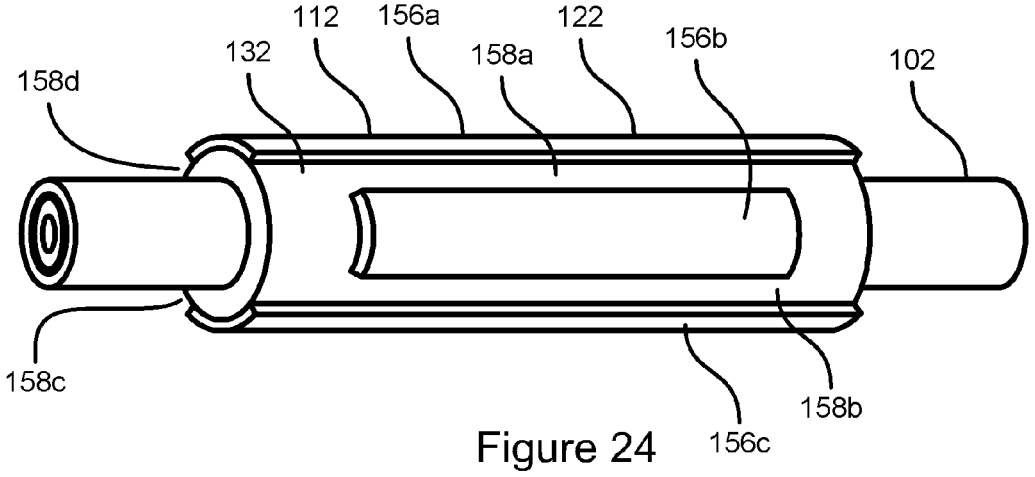
FIG. 24 is a perspective view of the choke and electrical cable 102 of Figure.
Figure 25:
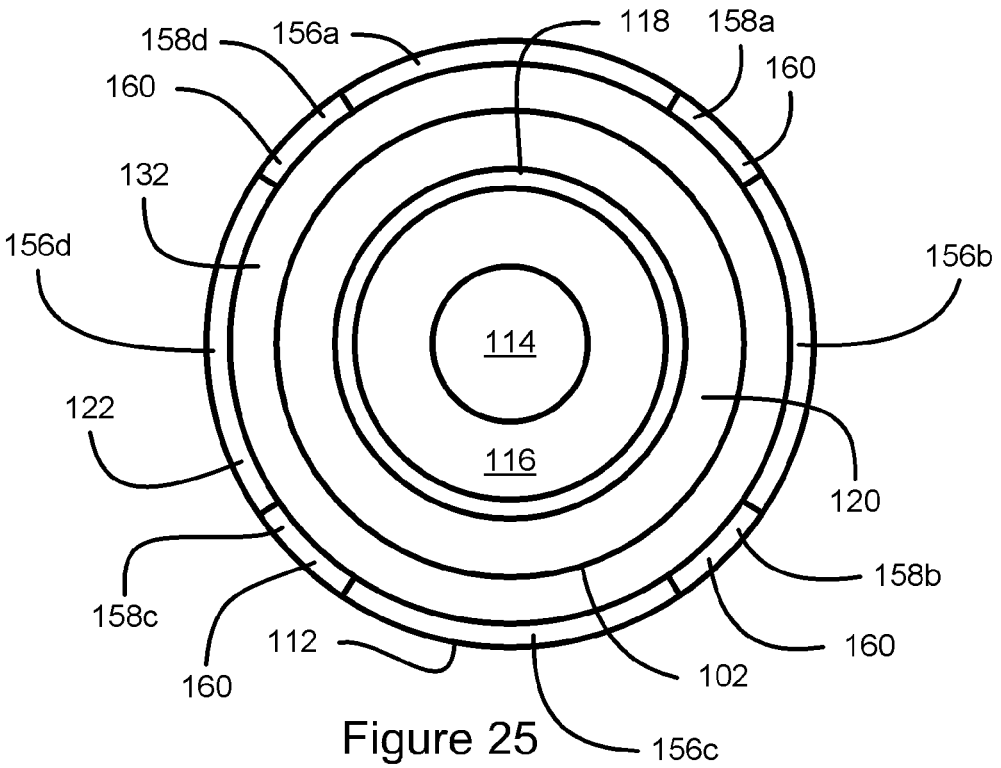
FIG. 25 is a cross-sectional view of another example embodiment of a choke coupled to an electrical cable.
Figure 26:
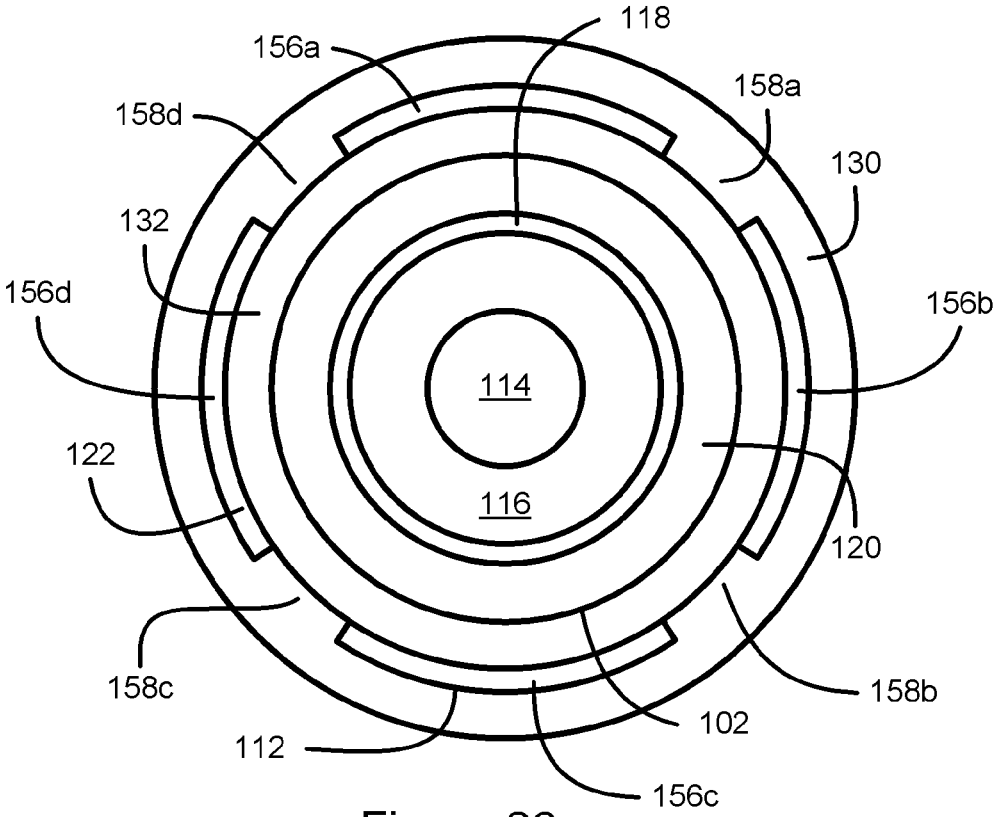
FIG. 26 is a cross-sectional view of another example embodiment of a choke coupled to an electrical cable.

FIG. 23 is a cross-sectional view of an example embodiment of a choke 112 coupled to an electrical cable 102. FIG. 24 is a perspective view of the choke 112 and electrical cable 102 of FIG. 23. The choke 112 can include multiple slots 158*a-d*, which can separate multiple panels 156*a-d* of an electro-conductive sleeve 122. As shown in FIGS. 23-24, the choke 112 can include 4 slots 158*a-d*, which can separate the sleeve 122 into 4 panels 156*a-d*. Other configurations are possible, for example, 1, 2, 3, 5, 6, 7, 8, or more slots and/or panels can be used. In some embodiments, there may not be any limit to the number of slots employed in the choke 112, other than space constraints. In some embodiments, the multiple slots 158*a-d* can produce multiple panels 156*a-d*, which can be electrically insulated from each other. For example, the slots 158*a-d* can be partially or substantially completely filled with insulating material from the outer jacket 130 (as shown in FIG. 26), with insulating material from the insulating layer 132 (similar to FIG. 18), with a separate insulating material 160 (as shown in FIG. 25), or with air.

With reference to FIG. 24, at least two of the panels 156*a-d* can have different lengths, e.g., for suppressing signals of different wavelengths, which can increase the effective frequency and/or wavelength range of the choke 112. In some embodiments, all the panels 156*a-d* can have different lengths from each other. In some embodiments, two or more of the panels 156*a-d* can have substantially the same length and can cooperate to suppress an undesired signal of a the same frequency or wavelength or range thereof. For example, opposing panels 156*a* and 156*c* can have substantially the same length as each other (e.g., a first length), while opposing panels 156*b* and 156*d* can have substantially the same length as each other (e.g., a second length that is different (e.g., shorter) than the first length). Thus, the panels 156*a-d* can have a length that is different than one or both of the adjacent panels 156*a-d*. The panels 156*a* and 156*c* of the first length can be configured to suppress a first frequency range or band, and the panels 156*b* and 156*d* of the second length can be configured to suppress a second frequency range or band that is different than the first frequency range or band. Accordingly the choke 112 can be a dual-band choke. In some embodiments, additional frequency ranges or bands can be suppressed (e.g., by additional panels or by additional sleeves). Many variations are possible. In some embodiments, all the panels 156*a-d* can have substantially the same length, e.g., such that the panels 156*a-d* cooperate to suppress signals of the same wavelength or frequency or range thereof. The different frequency or wavelength ranges or band being suppressed by the different panels 156*a-d* can overlap or not overlap.

Figure 27:
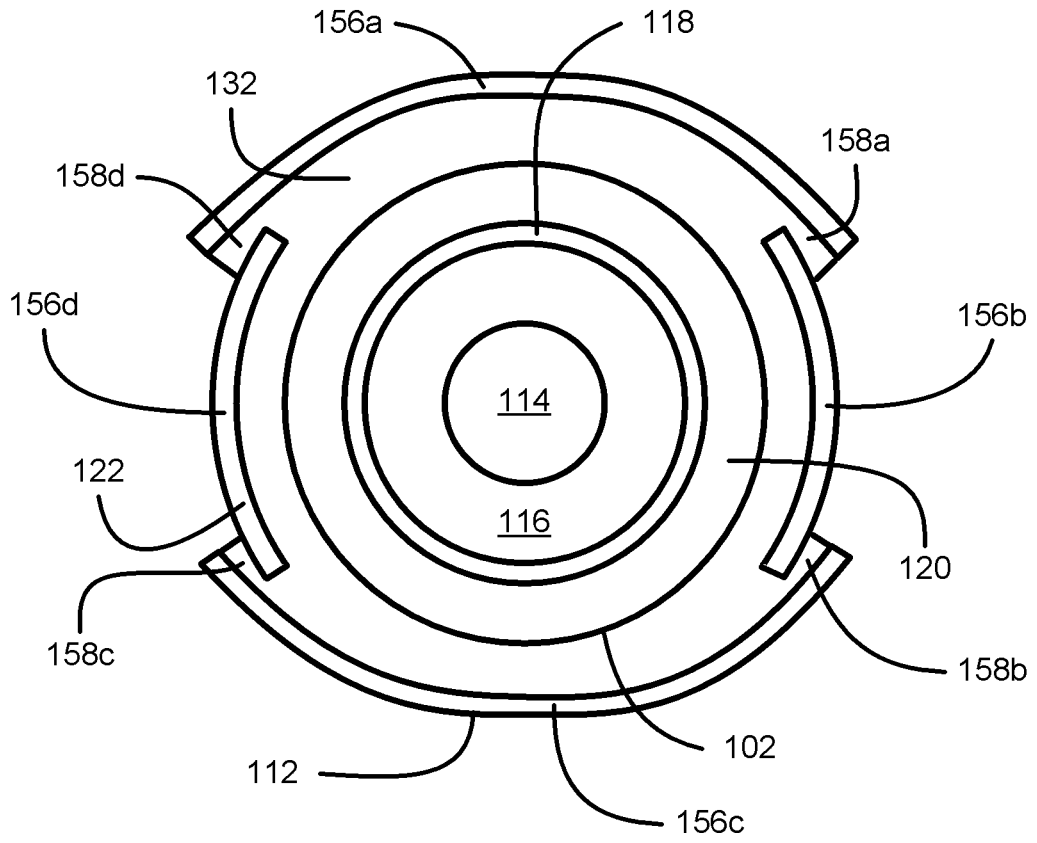
FIG. 27 is a cross-sectional view of another example embodiment of a choke coupled to an electrical cable.

With reference to FIG. 27, in some embodiments, one or more of the panels 156*a-d* can have ends the overlap adjacent panels 156*a-d*. For example, end portions of the panels 156*a* and 156*c* can be disposed over (e.g., radially outward of) corresponding end portions of the panels 156*b* and 156*d*. Insulating material (e.g., part of the additional insulation material layer 132, or separate insulating material, etc.) can be disposed between the overlapping end portions of the panels 156*a-d*. In some embodiments, the overlapping end portions of the panels 156*a-d* can be capacitively coupled ((e.g., such that the overlapping end portions of the panels 156*a-d* of the sleeve 122 can form, or operate as, a capacitor).

Figure 28:
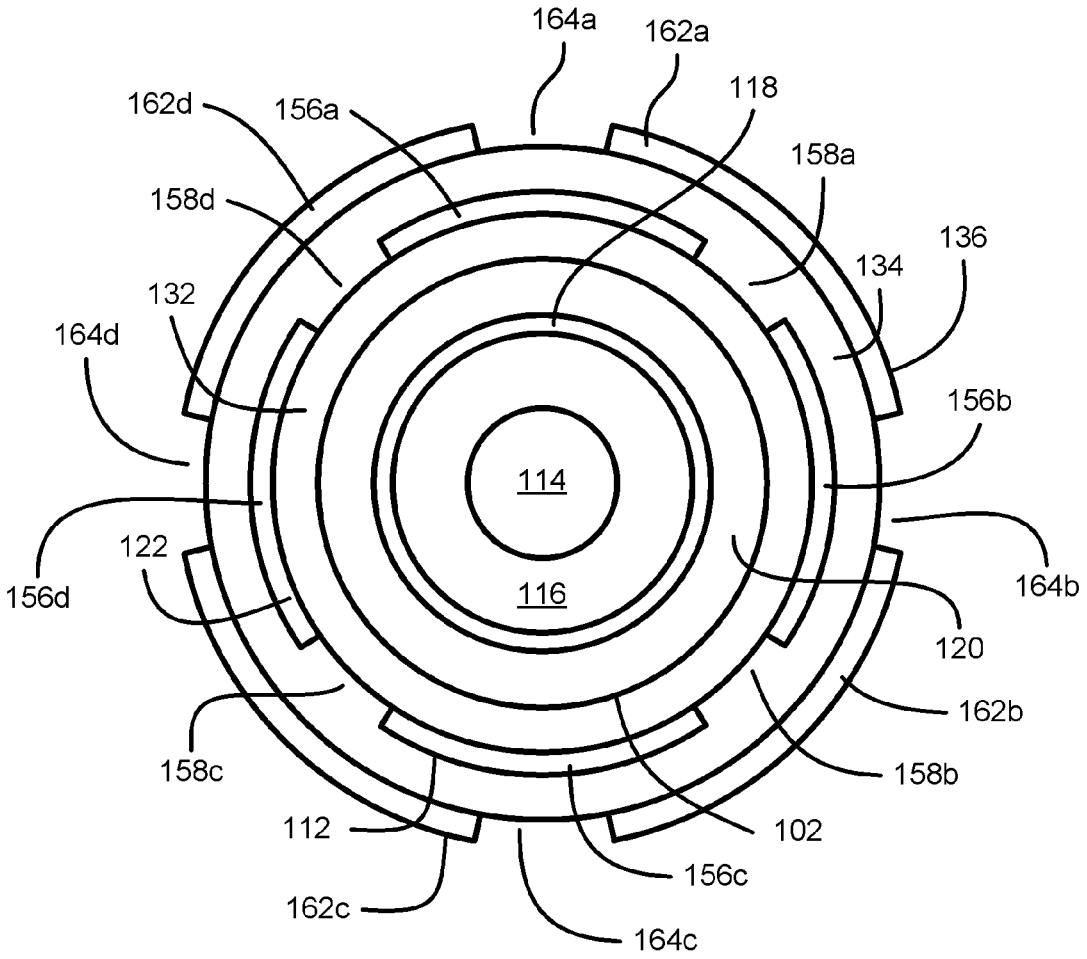
FIG. 28 is a cross-sectional view of another example embodiment of a choke coupled to an electrical cable.

With reference to FIG. 28, in some embodiments, one or more additional sleeves 136 can be included, which can have multiple panels 162*a-d* that are separated by multiple slots 164*a-d*. The panels 162*a-d* and slots 164*a-d* can be similar to the panels 156*a-d* and slots 158*a-d* discussed herein. An insulating layer 134 can be positioned between the panels 156*a-d* of the sleeve 122 and the panels 162*a-d* of the sleeve 136. The panels 162*a-d* of the one or more additional sleeves 136 can increase the effective frequency or wavelength range of the choke 112 and/or can increase the amount of signal suppression provided by the choke 112.

The embodiments that include one or more slots (e.g., FIGS. 14-28) can have a sleeve 122 that covers less than the full cross-sectional perimeter of the cable 102 or choke 112, although in some cases the one or more slots can be formed between overlapping portions of the sleeve 112 (e.g., as shown in FIGS. 19 and 27), and the sleeve 112 can extend around a full cross-sectional perimeter of the cable 102. In a multi-panel sleeve 122 (e.g., as shown in FIGS. 23-28), the combined cross-sectional perimeter of the two or more panels (e.g., taken at a location that intersects all of the two or more panels of the sleeve 122) can extend around less than the full cross-sectional perimeter of the cable 102 or choke 112. In the embodiments that include one or more slots (e.g., FIGS. 14-28), the sleeve 112 can extend around at least about 25%, at least about 40%, at least about 50%, at least about 60%, at least about 70%, at least about 80%, at least about 90%, at least about 95%, or more of the cross-sectional perimeter of the cable 102 or of the choke 112. In some embodiments, the sleeve 122 can extend around less than about 98%, less than about 95%, less than about 80%, less than about 70%, less than about 60%, less than about 50%, less than about 40%, or less than the cross-sectional perimeter of the cable 102 or of the choke 112. Various chokes and sleeves are disclosed herein as having a generally cylindrical shape, e.g., having a generally circular cross-sectional shape. Chokes and sleeves of various other cross-sectional shapes can be used (e.g., rectangular or other polygonal shapes). In some embodiments, the cross-sectional shape of the choke or sleeve can generally conform to the shape of the cross-sectional perimeter of an electrical cable associated with the choke or sleeve. For example, if an electrical cable is used having a non-circular cross-sectional shape (e.g., a rectangular shape), a choke or sleeve applied thereto can have a non-circular cross-sectional shape (e.g., a rectangular shape).

Many of the features of the various embodiments of chokes 112 disclosed herein can be combined to form various different combinations and subcombinations. In some embodiments, multiple sleeves 122 and 136 (e.g., 2, 3, 4, 5, or more sleeves) of the same type or of different types (e.g., seamless sleeves, seamed sleeves, slotted sleeves, sleeves with overlapping end portions, and/or multi-panel sleeves, in various combinations) can be coupled (e.g., substantially concentrically) to the cable 102. As mentioned above, in some embodiments, three, four, five, or more sleeves can be used together (e.g., positioned substantially concentrically) in the choke 112. In some embodiments, each of the sleeves of the choke is configured to suppress PIM. Many other variations are possible. For example, the chokes disclosed herein can have an outer jacket 130 disposed thereover, even if not specifically discussed or shown in the drawings. Also, the additional insulation material 132 can be omitted from the various embodiments disclosed herein, such that the sleeve 122 can be disposed directly adjacent to the outer surface of the electrical cable 102. Although some of the drawings are not necessarily drawn to scale, the dimensions shown in the Figures is intended for form a part of this disclosure.

In some embodiments, multiple chokes or multiple sleeves can be placed in a series along the length of an electrical cable 102, to enable wider frequency band ranges. In some instances, there are no limits to the number of chokes or sleeves that can be placed in series, other than space constraints on the cable 102. For example, the choke 112 can include 2, 3, 4, 5, or in some cases many more sleeves in series along the length of the cable 102. Either single layer sleeves or multi-layered sleeves can be placed in series along the length of the cable 102. In some embodiments, two or more sleeves can be placed in series over the same layer of additional insulating material 132, or the sleeves that are placed in series can be disposed over separate layers of additional insulating material 132.

As mentioned above, the actual or optimal length for a half-wave sleeve can be different than that half the wavelength of the signal being suppressed, and the actual or optimal length of a quarter-wave sleeve can be different that one-fourth (0.25) of the wavelength of the signal being suppressed. In some embodiments, the length of a quarter-wave sleeve or a half-wave sleeve can be determined based at least in part on one or more of the following:

- frequency (e.g., the frequency of the signal to be suppressed);
- the diameter of the cable;
- the thickness of the outer jacket of the cable;
- the dielectric constant of the outer jacket of the cable;
- the thickness of additional insulating material disposed under the sleeve;
- the dielectric constant of the additional insulating material; and/or
- the fringe effects of the sleeve.

Depending on the above-identified factors, the actual or optimal length for a half-wave sleeve can be different (e.g., larger or smaller) from the distance of half the wavelength in free space by less than or equal to about 1%, less than or equal to about 3%, less than or equal to about 5%, less than or equal to about 10%, less than or equal to about 15%, less than or equal to about 20%, less than or equal to about 30%, less than or equal to about 40%, less than or equal to about 50%, less than or equal to about 75%, or less than or equal to about 95%, by at least about 1%, at least about 2%, at least about 3%, at least about 5%, at least about 7%, at least about 10%, at least about 15%, at least about 20%, at least about 30%, at least about 50%, at least about 70%, or at least about 90%. By way of example, if the outer jacket and/or the additional insulating material have sufficient thickness, the length of the half-wave sleeve can be shortened enough that the length of the half-wave sleeve is actually closer to the value of one-fourth (0.25) the free space wavelength being suppressed than to the value of half (0.5) the free space wavelength being suppressed. In some embodiments, a half-wave sleeve can be configured to suppress a signal having a target wavelength for the signal propagating in the structure in which the signal propagates. For example, an undesired signal can propagate in the insulating outer jacket 120, on the outside of the shielding layer 118, of an electrical cable 102. Accordingly, the signal propagating in the insulating outer jacket 120 can have a wavelength that is smaller than the wavelength of the signal in free space. Thus, in this example, a half-wave sleeve 122 that is configured to suppress the undesired signal can have a length that is less than the half the free space wavelength of the signal. However, the length of the half-wave sleeve 122 can be about half the wavelength of the signal as propagating in the insulating outer jacket 120 outside the shielding layer 118.

To determine the appropriate length for a half-wave sleeve, the length of half (0.5) the wavelength in free space of the undesirable signal being suppressed can be used as a base or starting point, and the length can be adjusted (e.g., shortened or lengthened) based at least in part on the values for one or more of the variables identified above. For example, if additional insulating material is included (e.g., increasing the effective thickness of the outer jacket), the length of the sleeve can be shortened to accommodate the additional insulating (e.g., dielectric) material. The adjustment for fringing fields may be calculated by either analytical or numerical methods, or may be determined experimentally. In some embodiments, two or more of the above-identified factors can be considered in the order set forth above, although the factors can be considered in various other orders as well. In some embodiments, two or more of the factors can be considered together. The length of the sleeve can be determined by first considering the frequency of the signal to be suppressed. Then, the length of the sleeve can be adjusted by considering the diameter of the cable and/or the thickness of the outer jacket. Then, the length of the sleeve can be adjusted by considering the dielectric constant of the outer jacket of the cable. Then, the length of the sleeve can be adjusted to accommodate for fringe effects of the sleeve. Various other orders, or other alternatives, are possible. In some embodiments, the sleeve can be re-optimized at multiple steps (e.g., at each step) of the optimization process, which can facilitate confirmation that the sleeve is performing in the frequency range desired. The length of the sleeve can be determined using computer hardware that includes one or more computer processors, as discussed herein.

Figure 29:
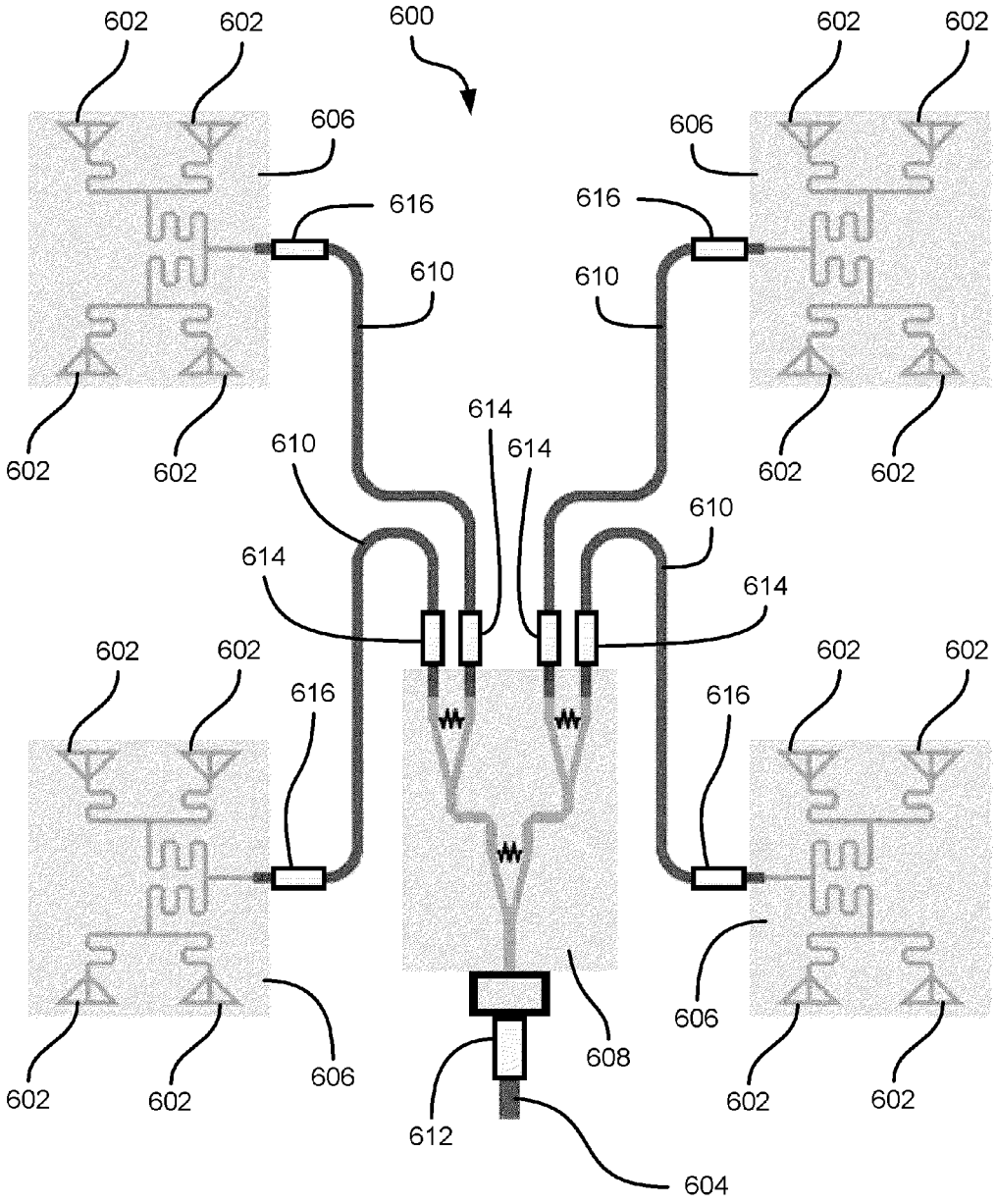
FIG. 29 schematically shows an example embodiment showing multiple chokes incorporated into an antenna array assembly.

The chokes disclosed herein can be used with various types of device and in various different contexts. For example, a choke can be disposed on a cable (e.g., coaxial cable) that provides power and/or signals to an electronic device (e.g., an antenna). FIG. 29 schematically shows an example embodiment showing multiple chokes incorporated into an antenna array assembly 600. The embodiment of FIG. 29 is shown by way of example, and many other configurations that are different than the example shown in FIG. 29 are possible. In the illustrated embodiment, at total of 16 antenna elements 602 are included, but various other numbers of antenna elements 602 can be included in the array (e.g., 2, 3, 4, 8, 16, 24, 32, 64, or more antenna elements), and the sleeves disclosed herein can be used in connection with a single antenna element as well. The antenna array assembly 600 can include a plurality of antenna elements 602 coupled to one or more feed lines 604 (e.g., which can lead to a radio transmitter or receiver, not shown in FIG. 29). In some embodiments, a plurality of antenna elements 602 can be coupled to one feed line 604, although in some embodiments, each antenna element 602 may be coupled to a separate feed line and/or to a separate radio transmitter or receiver.

In some embodiments, multiple antenna elements 602 can be incorporated into an antenna sub-array 606, which can be a printed circuit board antenna sub-array. In the illustrated embodiment, four antenna elements 602 are incorporated into an antenna sub-array 606, although other numbers of antenna elements 602 can be incorporated into the one or more antenna sub-arrays 606 (e.g., 2, 3, 4, 5, 6, 7, 8, or more antenna elements). The antenna sub-array 606 can include one or more inputs for receiving one or more cables 610, and can include one or more connectors that enable the cables 610 to be removably coupled to the antenna sub-array 606. The sub-array 606 can include a printed circuit board with line (e.g., conductive pathways) to transmit power and/or signals between the one or more inputs and the antenna elements 602.

The antenna array 600 can include a splitting module 608, which can be configured to couple multiple antenna elements 602 to one or more feed lines 604. The splitting module 608 can be a combiner, a divider, or a splitter, and in some embodiments, the splitting module can include, or be incorporated into, a printed circuit board. The splitting module 608 can include one or more feed line inputs for receiving the one or more feed lines 604. The splitting module 608 and the one or more feed lines 604 can have connectors configured to removably couple the one or more feed lines 604 to the splitting module 608. The splitting module 608 can include a plurality of antenna element inputs that are coupled to the plurality of antenna elements 602. The number of antenna element inputs can be greater than the number of feed line inputs, and in some cases a single feed line 604 can be used. Cables 610 (e.g., coaxial cables) can couple the antenna elements 602 to the slitting module 608. The splitting module 608 and the cables 610 can have connectors configured to removably couple the cables 610 to the splitting module 608.

The antenna array 600 can include one or more chokes. For example, a choke 612 can be disposed on the feed line 604, between the splitting module 608 and the radio transmitter or receiver. The choke 612 can be disposed adjacent or near the splitting module 608, as shown, or the choke 612 can be spaced away from the splitting module 608. In some embodiments, a choke can be disposed adjacent or near the radio antenna or receiver (not shown in FIG. 29) in addition to, or instead of, the choke 612. One or more chokes can be disposed on one or more of the cables 610 that couple the antenna elements 602 to the splitter module 608. One or more chokes 614 can be disposed adjacent or near the inputs to the splitter module 608 (e.g., at or near the ends of the cables 610). In some embodiments, the chokes 614 can be spaced apart from the inputs to the splitter module 608. One or more chokes 616 can be disposed adjacent or near the individual antenna elements 602, or the one or more chokes 616 can be spaced apart from the antenna elements 602. In embodiments that include antenna sub-arrays 606, one or more cables 610 can couple the antenna sub-array 606 to the splitter module 608 (e.g., by coupling the printed circuit board of the antenna sub-array 606 to the printed circuit board of the splitter module 608). The antenna sub-arrays 606 and the cables 610 can include connectors configured to removably couple the cables 610 to the antenna sub-arrays 606. The chokes 616 can be disposed adjacent or near the antenna sub-array 606 (e.g., at or near the ends of the cables 610), or the chokes 616 can be spaced apart from the antenna sub-array 606.

Each of the chokes 612, 614, and 616 can have features that are the same as, or similar to, the various chokes disclosed herein. For example, in some embodiments, the chokes 612, 614, and 616 can be configured to have low passive intermodulation (PIM), e.g., resulting from lower or substantially no nonlinearities. In some embodiments, the chokes 612, 614, and 616 can include a conductive sleeve, as disclosed herein (e.g., a half-wave sleeve). In some embodiments, one or more of the chokes 612, 614, and 616 can include multiple sleeves, which can be, for example, disposed one over the other (e.g., concentrically). The chokes 612, 614, and 616 can share common features or designs, or the various different chokes 612, 614, and 616 of the antenna array 600 can have features different than one or more of the other chokes 612, 614, and 616 of the array 600. For example, in some embodiments, all the chokes 612, 614, and 616 of the antenna array 600 can be configured to reduce or eliminate PIM, or some of the chokes 612, 614, and 616 can be configured to reduce PIM while others are not configured to reduce PIM. The various different chokes 612, 614, and 616 of the array 600 can be configured to reduce or eliminate signals of different frequencies, or two or more of the chokes 612, 614, and 616 can be configured to reduce or eliminate signals of substantially the same frequency. The chokes 612, 614, and 616 can have sleeves of different lengths, or of similar lengths, or of substantially the same length.

Figure 30:
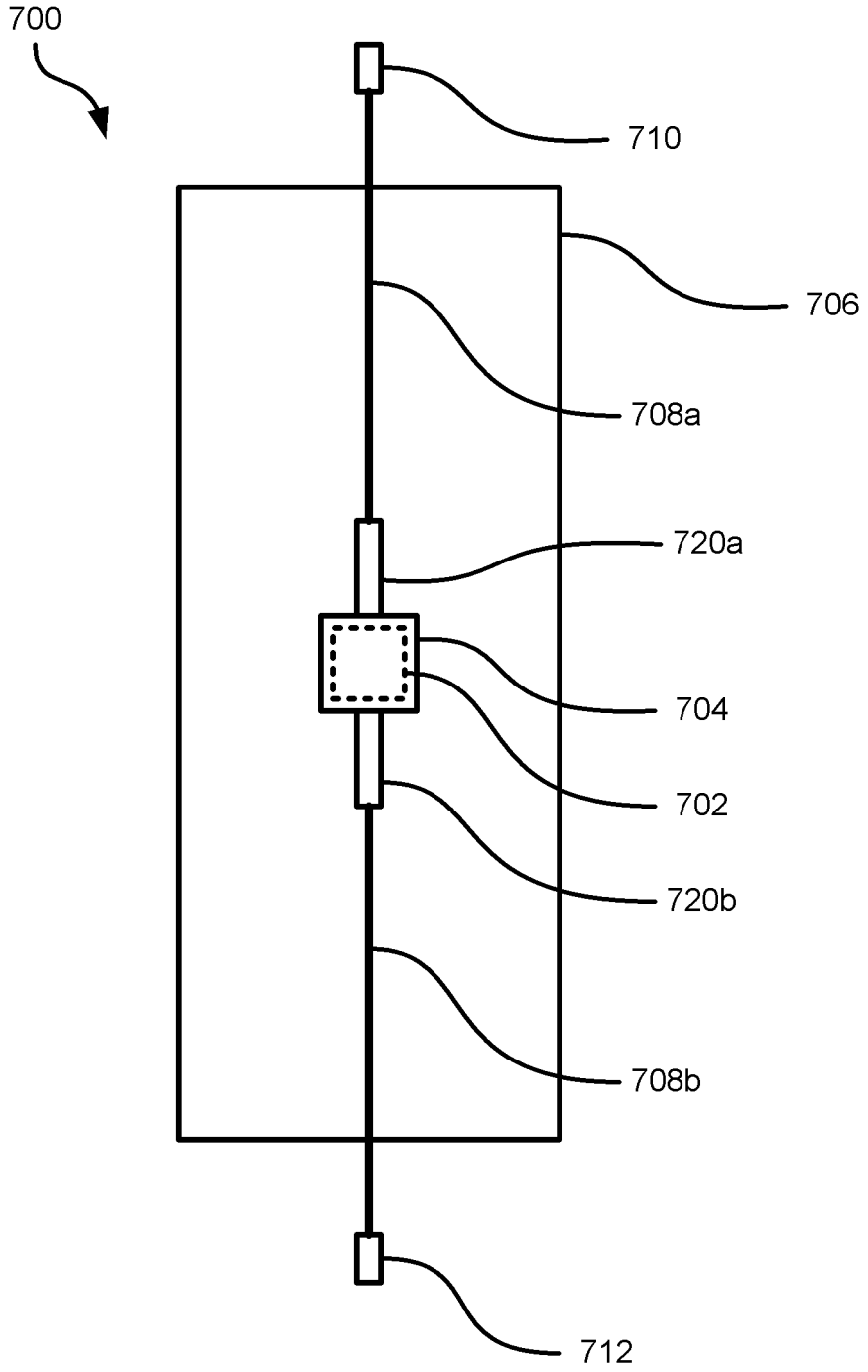
FIG. 30 shows multiple chokes incorporated into an electrical system that includes a radiating component and a shield member.

With reference to FIG. 30, in some embodiments, the chokes disclosed herein can be used with a shield member that shields a radiating component. FIG. 30 shows a radiating component 702 and a shield member 704 configured to attenuate or block at least some of the energy (e.g., radio frequency radiation) radiated from the radiating component 702. In the context of an antenna array assembly 700, an array tray 706 can support one or more cable 708*a* and 708*b* (e.g., coaxial cables). The cables 708*a* and 708*b* can extend between two components of the antenna array assembly 700. For example, the cables 708*a* and 708*b* can couple an antenna element or an antenna sub-array to a feed line or splitter module (e.g., a power splitter). In some embodiments a connector 710 at a first end (e.g., the upper) of a first (e.g., upper) cable 708*a* can be configured to connect (e.g., removably connect) to an antenna element or an antenna sub-array. In some embodiments, a connector 712 at a second end (e.g., the lower) of the second (e.g., lower) cable 708*b* can be configured to connect (e.g., removably connect) to a feed line or a splitting module (e.g., a power splitter) of the antenna array 700. One or more of the connectors 710 and 712 can be a DIN connector, although various other connector types or other terminations can be used at the ends of the cables 708*a* and 708*b*.

The assembly 700 can include a radiating component 702. The first (e.g., upper) cable 708 can extend from the radiating component 702 to the first (e.g., upper) connector 710, and the second (e.g., lower) cable 708*b* can extend from the radiating component 702 to the second (e.g., lower) connector 712. The radiating component 702 can be a phase shifter, although various other types of radiating components 702 may be used. For example, the radiating component can be a processor (e.g., a central processing unit (CPU), an RF radio, an active or passive device, etc. The radiating component 702 (e.g., phase shifter) can include, or be incorporated into, a printed circuit board. In some embodiments, the radiating component 702 does not include, and is not incorporated into, a printed circuit board. In some embodiments, the cables 708*a* and 708*b* and the radiating component 702 can include connectors that are configured to removably couple the cables 708*a* and 708*b* to the radiating component 702.

Figure 31:
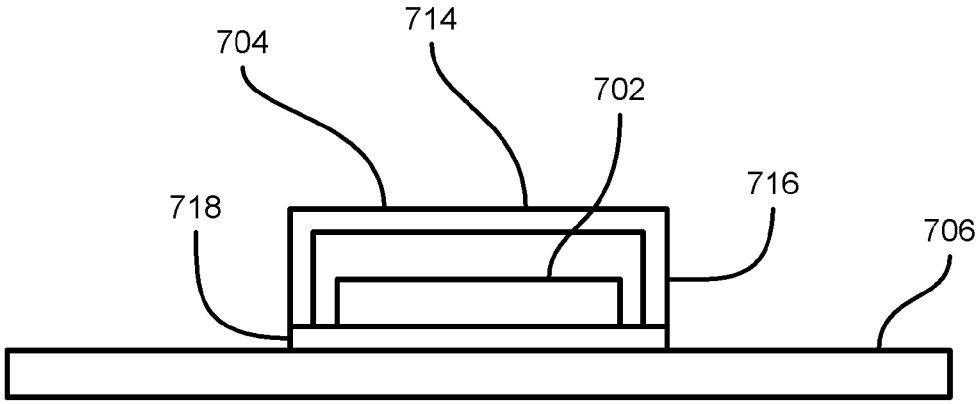
FIG. 31 is a cross-sectional view taken through the radiating component and shield member of FIG. 30.

A shield member 704 can be configured to attenuate or block at least some of the energy (e.g., radio frequency radiation) radiated from the radiating component 702. FIG. 31 is a schematic cross-sectional view taken through the shield member 704 and radiating component 702. The shield member 704 can be a covering that fits over the radiating component 702. The shield member 704 can have, for example, a top portion 714 and side walls 716, and the bottom can be open to provide access to the interior of the shield member 704. As shown in FIG. 31 the shield member 704 can be placed over the radiating component 702 such that the radiating component 702 is received into the interior of the shield member 704. In some embodiments, insulator 718 can be disposed between the shield member 704 and the array tray 706, to electrically insulate the shield 704 from the array tray 706. The shield member 704 can be made from an electrically conductive material (e.g., aluminum), and the array tray 706 can also be made from an electrically conductive material (e.g., aluminum). The insulator 718 can be a plastic or other insulating material. In some embodiments, the insulator 718 can also electrically insulate the radiating component 702 from the array tray 706. For example, the insulator 718 can include insulating material that extends under the radiating component 702 and the shield member 704.

With reference again to FIG. 30, the assembly 700 can include one or more chokes 720*a* and 720*b*. In the illustrated embodiment, a first choke 720*a* is disposed on the first (e.g., upper) cable 708*a*, and a second choke 720*b* is disposed on the second (e.g., lower) cable 708*b*. The chokes 720*a* and 720*b* can be configured to suppress common mode EMI or RFI, as discussed herein. The chokes 720*a* and 720*b* can be configured to suppress PIM, as discussed herein. The chokes 720*a* and 720*b* can be disposed adjacent or near the shield member 704, or they can be spaced apart from the shield member 704. In some embodiments, the one or more chokes 720*a* and 720*b* can be coupled to the shield member 704. For example, a choke 720*a* or 720*b* can be attached to the outside of the shield member 704 (e.g., to a side wall 716 thereof) by an adhesive or other suitable attachment mechanism. As discussed herein the choke 720*a* or 720*b* can include a conductive sleeve, and an insulating material can be disposed between the conductive sleeve of the choke 720*a* or 720*b* and the conductive shield member 704. The one or more chokes 720*a* and 720*b* can be positioned on the shield member 704 such that the chokes 720*a* and 720*b* fit over the cables 708*a* and 708*b* when the shield member 704 is positioned over the radiating component 702.

Figure 32:
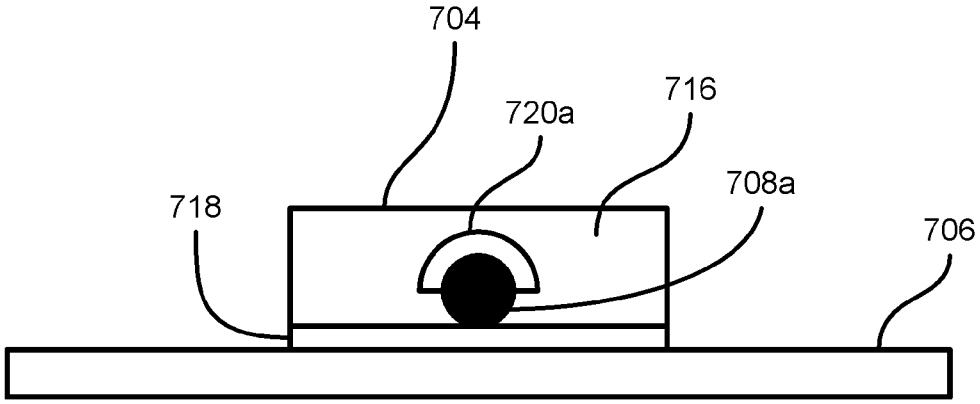
FIG. 32 is a cross-sectional view taken through a choke of FIG. 30.

FIG. 32 is a schematic cross-sectional view taken through the choke 720*a* and the cable 708*a*. The choke 720*a* can include a sleeve that extends only partially around the cross-sectional perimeter of the cable 708*a*. For example, the sleeve can include a gap, and the choke can be configured to suppress PMI, as discussed herein. In some embodiments, the sleeve can extend at least about 25%, at least about 40%, at least about 50%, at least about 60%, at least about 70%, at least about 80%, at least about 90%, or more of the cross-sectional perimeter of the cable 708*a*. In some embodiments, the sleeve can extend less than about 95%, less than about 80%, less than about 70%, less than about 60%, less than about 50%, less than about 40%, or less than the cross-sectional perimeter of the cable 708*a*. In some embodiments, the sleeve can extend around about 50% of the cross-sectional perimeter of the cable 708*a*. A sleeve that extends only partially around the cross-sectional perimeter of the cable 708*a* can be useful in preventing the sleeve from contacting the array tray 706. Also, a sleeve that extends only partially around the cross-sectional perimeter of the cable 708*a* can be useful for embodiments in which the choke 720*a* is coupled to the shield member 704 by facilitating placement of the choke 720*a* over the cable 708*a* when the shield member 704 is positioned over the radiating component 702. In some embodiments, the sleeve can extend around the full cross-sectional perimeter of the cable 708*a*, as described herein for certain example embodiments of chokes.

In some embodiments, the shield member 704 can cause at least a portion of the radiated energy (e.g., radio frequency radiation) that is intercepted by the shield member 704 to be coupled into the cables 708*a* and 708*b*. The chokes 720*a* and 720*b* can be configured to attenuate or block the flow of the energy (e.g., radio frequency radiation) on the cables 708*a* and 708*b*.

Although FIG. 30 shows a single set of cables 708*a* and 708*b* and a single radiating component 702 (e.g., phase shifter) assembly, the array tray 706 can support a plurality (e.g., 2, 3, 4, 6, 10, or more) of sets of cables and radiating components (e.g., phase shifters), which can couple to a plurality of antenna elements or antenna sub-arrays. The array tray 706 can be positioned upright in an antenna array assembly 700, and can have a height of about 6 feet and a width of about 1 foot, although the array tray 706 may have various other dimensions depending on the characteristics of the antenna array assembly 700. In some embodiments, a radome (not shown in FIG. 30) can be included, and can the radome can be positioned to protect the antenna array assembly 700.

Various different configurations, other than that shown in FIG. 30 are possible, and the shield member 704 and one or more sleeves 720*a* and 720*b* described above can be used in various other contexts other than antenna array assemblies. Although FIG. 30 shows two cables 708*a* and 708*b* exiting the shield member 704, a different number of cables (e.g., 1, 3, 4, 5, 8, 12, or more cables) can be used, depending on the configuration of the radiating component 702, and some or all of the cables can include one or more chokes.

The various illustrative logical blocks, modules, and processes described herein may be implemented as electronic hardware, computer software, or combinations of both. To clearly illustrate this interchangeability of hardware and software, various illustrative components, blocks, modules, and states have been described above generally in terms of their functionality. However, while the various modules are illustrated separately, they may share some or all of the same underlying logic or code. Certain of the logical blocks, modules, and processes described herein may instead be implemented monolithically.

The various illustrative logical blocks, modules, and processes described herein may be implemented or performed by a machine, such as a computer, a processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A processor may be a microprocessor, a controller, microcontroller, state machine, combinations of the same, or the like. A processor may also be implemented as a combination of computing devices, e.g., a combination of a DSP and a microprocessor, a plurality of microprocessors or processor cores, one or more graphics or stream processors, one or more microprocessors in conjunction with a DSP, or any other such configuration.

The blocks or states of the processes described herein may be embodied directly in hardware, in a software module executed by a processor, or in a combination of the two. For example, each of the processes described above may also be embodied in, and fully automated by, software modules executed by one or more machines such as computers or computer processors. A module may reside in a computer-readable storage medium such as RAM memory, flash memory, ROM memory, EPROM memory, EEPROM memory, registers, hard disk, a removable disk, a CD-ROM, memory capable of storing firmware, or any other form of computer-readable storage medium known in the art. An exemplary computer-readable storage medium can be coupled to a processor such that the processor can read information from, and write information to, the computer-readable storage medium. In the alternative, the computer-readable storage medium may be integral to the processor. The processor and the computer-readable storage medium may reside in an ASIC.

Depending on the embodiment, certain acts, events, or functions of any of the processes or algorithms described herein can be performed in a different sequence, may be added, merged, or left out altogether. Thus, in certain embodiments, not all described acts or events are necessary for the practice of the processes. Moreover, in certain embodiments, acts or events may be performed concurrently, e.g., through multi-threaded processing, interrupt processing, or via multiple processors or processor cores, rather than sequentially.

Conditional language used herein, such as, among others, "can," "could," "might," "may," "e.g.," and from the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the logical blocks, modules, and processes illustrated may be made without departing from the spirit of the disclosure. As will be recognized, certain embodiments of the inventions described herein may be embodied within a form that does not provide all of the features and benefits set forth herein, as some features may be used or practiced separately from others.

What is claimed is:

1. A cross-dipole antenna system, comprising:

a cross-dipole antenna element, comprising:

a first arm;

a second arm, the first and second arms forming a first dipole;

a third arm; and a fourth arm, the third and fourth arms forming a second dipole, wherein each of the arms lie in a plane and are spaced apart from each other by about 90 degrees, such that a proximal end of each of the arms is arranged near a center point and wherein each of the plurality of arms extends distally outward from the center point, wherein the cross-dipole antenna element has a substantially horizontal polarization orientation;

a coaxial electrical cable coupling the cross-dipole antenna element to an electrical component and having an insulating outer jacket; and a half-wavelength choke configured to suppress electromagnetic interference (EMI) and/or radio frequency interference (RFI) having a target wavelength, the half-wavelength choke comprising:

a first electro-conductive sleeve having a first length and configured to be disposed over an outer surface of an electrical cable;

a first insulating layer disposed between the first electro-conductive sleeve and the electrical cable;

a second electro-conductive sleeve having a second length and disposed over the first electro-conductive sleeve; and a second insulating layer disposed between the first electro-conductive sleeve and the second electro-conductive sleeve.

2. The cross-dipole antenna system of claim 1, wherein the first length is about half of the target wavelength.

3. The cross-dipole antenna system of claim 2, wherein the second electro-conductive sleeve is configured to increase the amount of suppression of EMI and/or RFI of the target wavelength.

4. The cross-dipole antenna system of claim 3, wherein the second electro-conductive sleeve has a length that is shorter than the first electro-conductive sleeve.

5. The cross-dipole antenna system of claim 1, wherein the first electro-conductive sleeve and the second electro-conductive sleeve are electrically insulated from the electrical cable.

6. The cross-dipole antenna system of claim 1, wherein the first insulating layer is configured to increase the frequency range of EMI and/or RFI suppressed by the choke.

7. The cross-dipole antenna system of claim 1, wherein the choke is configured to suppress common mode EMI and/or RFI.

8. The electrical system of claim 1, wherein the electrical cable has a radius and wherein the first insulating layer and the second insulating layer have combined thickness of about 5% to about 200% of the radius of the electrical cable.

9. The electrical system of claim 1, wherein the electrical cable has a radius and wherein the additional insulating material has a thickness of about 50% to about 100% of the radius of the electrical cable.

* * * * *